US010367243B2

(12) United States Patent
Gnanou et al.

(10) Patent No.: US 10,367,243 B2
(45) Date of Patent: Jul. 30, 2019

(54) MINIATURE LTCC COUPLED STRIPLINE RESONATOR FILTERS FOR DIGITAL RECEIVERS

(71) Applicant: BAE SYSTEMS Information and Electronic Systems Integration Inc., Nashua, NH (US)

(72) Inventors: Souleymane Gnanou, Salem, NH (US); James M. Huggett, Brookline, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 165 days.

(21) Appl. No.: 15/584,191

(22) Filed: May 2, 2017

(65) Prior Publication Data

US 2018/0323485 A1 Nov. 8, 2018

(51) Int. Cl.
*H01P 1/203* (2006.01)
*H01P 7/08* (2006.01)

(52) U.S. Cl.
CPC ..... *H01P 1/20345* (2013.01); *H01P 7/08* (2013.01)

(58) Field of Classification Search
CPC .. H01P 1/203; H01P 1/20327; H01P 1/20336; H01P 1/20345; H01P 7/08
USPC ..... 333/203–206, 219, 235
See application file for complete search history.

(56) References Cited

U.S. PATENT DOCUMENTS

2016/0365616 A1* 12/2016 Baldwin ..... H01P 1/20327

OTHER PUBLICATIONS

DuPont GreenTape 9K7, Technical Data Sheet, 2009.
Bailey et al., "Miniature LTCC Filters for Digital Receivers", IEEE MTT-S Digest, pp. 999-1002, 1997.
Zhang et al., "Miniature Broadband Bandpass Filters Using Double-Layer Coupled Stripline Resonators", IEEE Transactions on Microwave Theory and Techniques, vol. 54, No. 8, pp. 1-8, Aug. 2006.
Zhang et al., "LTCC Multi-layer Coupled Strip-Resonator Filters", IEEE, pp. 1039-1042, 2007.
Chirap et al., "Insertion loss measurement of a lowpass microwave filter manufactured on FR4 laminate", IEEE, pp. 231-234, 2016.

* cited by examiner

*Primary Examiner* — Rakesh B Patel
*Assistant Examiner* — Jorge L Salazar, Jr.
(74) *Attorney, Agent, or Firm* — Davis & Bujold, PLLC

(57) ABSTRACT

Low temperature co-fired ceramic (LTCC)-coupled stripline resonator filters for use as bandpass filters are implemented with combline topology or with interdigital topology. The filter bandwidths range from about 0.3 GHz to less than 1 GHz with frequency operation of about 0.1 GHz to 100 GHz. The filters have vias between adjacent resonators with via spacing significantly smaller than the wavelength at the filter center frequency to generate electrical walls between adjacent resonators resulting in coupling reduction for narrowband filter implementation. A narrowband filter transformer loading structure launches the input and the output to the first and last resonators.

10 Claims, 34 Drawing Sheets

MINIATURE LTCC COUPLED STRIPLINE RESONATOR FILTERS FOR DIGITAL RECEIVERS

STATEMENT OF GOVERNMENT INTEREST

This disclosure was made with United States Government support under Contract N66001-14-4006 awarded by the U.S. Department of the Navy. The United States Government has certain rights in this disclosure.

FIELD OF THE DISCLOSURE

The present disclosure relates to generating electrical wall between adjacent resonators to significantly reduce the coupling between them to implement narrowband miniature low temperature co-fired ceramic (LTCC)-coupled stripline resonator filters for digital receivers.

BACKGROUND OF THE DISCLOSURE

A low temperature co-fired ceramic (LTCC) material system consists of a low firing temperature ceramic with multiple layers of high conductivity metals (e.g., gold, silver, and copper) used in a thin film processes. This technology allows for low temperature (<1000° C.) processing of three dimensional packages and the use of conventional chip and wire technologies for the fabrication of various LTCC packages.

LTCC is a glass matrix ceramic with a crystalline filler added or formed from the glass during the firing process. The crystalline filler is added to control thermal expansion characteristics, to control the densification behavior of the LTCC, and to achieve specific electrical performance.

The development of LTCC technology has generated an increasing interest in multi-layer bandpass filters that meet the challenge of size, performance and cost requirements. The miniaturization of the LTCC filters expanded with the development of DuPont's GreenTape™ 9K7, a low loss material for high frequency applications. GreenTape™ provides a co-fireable system of gold, silver, and resistive components having low loss properties in excess of 100 GHz. However, new design concepts are still needed to exploit the material fully.

A simple stripline filter consists of three layers of conductors. The internal conductor is typically referred to as the "hot" conductor and the other two conductors, connected at signal ground, are typically referred to as "cold" or "ground" conductors. The "hot" conductor is embedded in an isotropic dielectric that completely surrounds the "hot" conductor.

The performance of microwave components in electronic systems is currently limited by increasingly difficult requirements on performance, size, weight, and power handling. Microwave filters comprise a large fraction of a module's space, while conventional miniaturized filters still suffer from high losses and degraded performance. Some current designs partially fill this gap but do not have a high enough Q-factor to achieve narrow bandwidths needed for high order Nyquist filtering applications or the low insertion losses needed for applications before any amplifier in an RF receiver or for enabling direct digital sampling of Radar.

The LTCC coupled stripline resonator filters proposed herein, for use as bandpass filters, are versatile and can be implemented with combline topology or with interdigital topology. The filter bandwidths of the present disclosure range from about 0.3 GHz to about 4.5 GHz. This bandwidth can be increased with an increase in 9K7 tape thickness. The frequency operation of the present filters is up into the high millimeter-wave (MMW) region. The millimeter-wave region of the electromagnetic spectrum is generally understood to have a wavelength from about 10 millimeters to about 1 millimeter. Millimeter waves are longer than infrared waves or x-rays, and shorter than radio waves or microwaves. The millimeter-wave region of the electromagnetic spectrum corresponds to radio band frequencies of about 30 GHz to about 300 GHz and may also be referred to as the Extremely High Frequency (EHF) range.

SUMMARY OF THE DISCLOSURE

Wherefore it is an object of the present disclosure to overcome the above-mentioned shortcomings and drawbacks associated with the prior art miniature stripline filters.

One aspect of the present disclosure is a low temperature co-fired ceramic stripline resonator filter comprising a first layer configured as a ground layer comprising a metal; a second layer comprising a dielectric material; a third layer configured as a conductor layer comprising the metal and the dielectric material, the metal comprising a plurality of resonators comprising a first half of a stripline resonator pair arranged with an interdigital topology; a fourth layer comprising the dielectric material; a fifth layer configured as a conductor layer comprising the metal and the dielectric material, the metal comprising a plurality of resonators comprising a second half of the stripline resonator pair arranged with an interdigital topology; a sixth layer comprising the dielectric material; a seventh layer configured as a ground layer comprising a metal; wherein the first, second, third, fourth, fifth, sixth and seventh layers are assembled to form an RF filter having a width, a length, a thickness, a first end and a second end, and a first side and a second side; a plurality of perimeter through plated vias spaced apart along the length of the first side and along the length of the second side of the RF filter and extending through the RF filter from the first layer to the seventh layer creating a series of electric walls to contain electromagnetic fields inside the RF filter; and a plurality of through plated vias located between adjacent resonators and extending through the RF filter from the first layer to the seventh layer to create a series of electric walls thereby reducing the coupling between the two adjacent resonators.

In certain embodiments of the low temperature co-fired ceramic stripline resonator filter, the dielectric material is any LTCC low loss dielectric material. In some cases, the metal is selected from gold or silver. The plurality of resonator poles may be between four and fourteen.

In some embodiments of the low temperature co-fired ceramic stripline resonator filter, the filter is a narrowband filter with a bandwidth of about 0.3 GHz to less than 1 GHz. In some cases, the filter has a center frequency ranging from 0.1 GHz to about 100 GHz.

Another aspect of the present disclosure is a low temperature co-fired ceramic stripline resonator filter comprising a first layer configured as a ground layer comprising a metal; a second layer comprising a dielectric material; a third layer configured as a conductor layer comprising the metal and the dielectric material, the metal comprising a plurality of resonators comprising a first half of a stripline resonator pair arranged with an interdigital topology; a fourth layer comprising the dielectric material; a fifth layer configured as a conductor layer comprising the metal and the dielectric material, the metal comprising a plurality of resonators comprising a second half of the stripline resonator pair arranged with an interdigital topology; a sixth layer comprising the dielectric material; a seventh layer configured as a ground layer comprising a metal; wherein the first, second, third, fourth, fifth, sixth and seventh layers are assembled to form an RF filter having a width, a length, a thickness, a first end and a second end, and a first side and a second side; and a plurality of perimeter through plated vias spaced apart along the length of the first side and along the length of the second side of the RF filter and extending through the RF filter from the first layer to the seventh layer creating a series of electric walls to contain electromagnetic fields inside the RF filter.

In certain embodiments of the low temperature co-fired ceramic stripline resonator filter, the dielectric material is any LTCC low loss dielectric material. In some cases, the metal is selected from gold or silver. The plurality of resonator poles may be between four and fourteen.

In some embodiments of the low temperature co-fired ceramic stripline resonator filter, the filter is a broadband filter with a bandwidth greater than 1 GHz. In some cases, the filter has a center frequency ranging from 0.1 GHz to about 100 GHz.

Yet another aspect of the present disclosure is a low temperature co-fired ceramic stripline resonator filter comprising a first layer configured as a ground layer comprising a metal; a second layer comprising a dielectric material; a third layer configured as a conductor layer comprising the metal and the dielectric material, the metal comprising a plurality of resonators comprising a first half of a stripline resonator pair arranged with a combline topology; a fourth layer comprising the dielectric material; a fifth layer configured as a conductor layer comprising the metal and the dielectric material, the metal comprising a plurality of resonators comprising a second half of the stripline resonator pair arranged with a combline topology; a sixth layer comprising the dielectric material; a seventh layer configured as a ground layer comprising a metal; wherein the first, second, third, fourth, fifth, sixth and seventh layers are assembled to form an RF filter having a width, a length, a thickness, a first end and a second end, and a first side and a second side; and a plurality of perimeter through plated vias spaced apart along the length of the first side and along the length of the second side of the RF filter and extending through the RF filter from the first layer to the seventh layer creating a series of electric walls to contain electromagnetic fields inside the RF filter.

In certain embodiments of the low temperature co-fired ceramic stripline resonator filter, the dielectric material is any LTCC low loss dielectric material. In some cases, the metal is selected from gold or silver. The plurality of resonator poles may be between four and fourteen.

In some embodiments of the low temperature co-fired ceramic stripline resonator filter, the filter is a broadband filter with a bandwidth greater than 1 GHz. In some cases, the filter has a center frequency ranging from 0.1 GHz to about 100 GHz.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

Certain embodiments of the LTCC coupled stripline resonator filters of the present disclosure enable integration of high quality narrow bandpass filters into the low power RF system of advanced radar and the communications systems for digital receivers. This new design scheme introduces a row of vias between two adjacent resonators. The row of through plated vias connects the top and bottom ground layers and behaves as an electric wall, thereby reducing the coupling between the two adjacent resonators.

While the initial filter concept was geared towards a broad bandpass filter design, the introduction of the electric wall between the two resonators resulted in narrowband coupling. By adjusting the gap between the two resonators with the "electric wall" in the middle the coupling is adjusted for use as a narrowband filter. Increasing the diameters of the vias in the electric wall for a fixed gap between the two adjacent resonators also reduces the coupling. The new filter design of the present disclosure can be implemented as combline filters or as interdigital filters depending on the application.

The filters described herein are versatile. Adding an "electric wall" between two adjacent resonators implements a narrowband bandpass filter, and the lack of an "electric wall" between two adjacent resonators implements a broad bandpass filter. As described in more detail below, a different input coupling structure is also required for the implementation of each type of filter, where narrowband band filters require capacitive loading structure and broadband filters require inductive loading structure.

Certain embodiments of the resonator filters of the present disclosure are made up of two strips in parallel-aligned layers, and by adjusting the capacitance between the two strips the resonator frequency can be tuned.

This narrative begins by describing embodiments of some narrowband filters with interdigital topology. Next, embodiments of some broadband filters having interdigital topology will discussed, followed by a discussion of some broadband filters having combline topology. The narrative will conclude with plots of various filters showing insertion losses, sensitivity data, and the like.

Figure 1A:
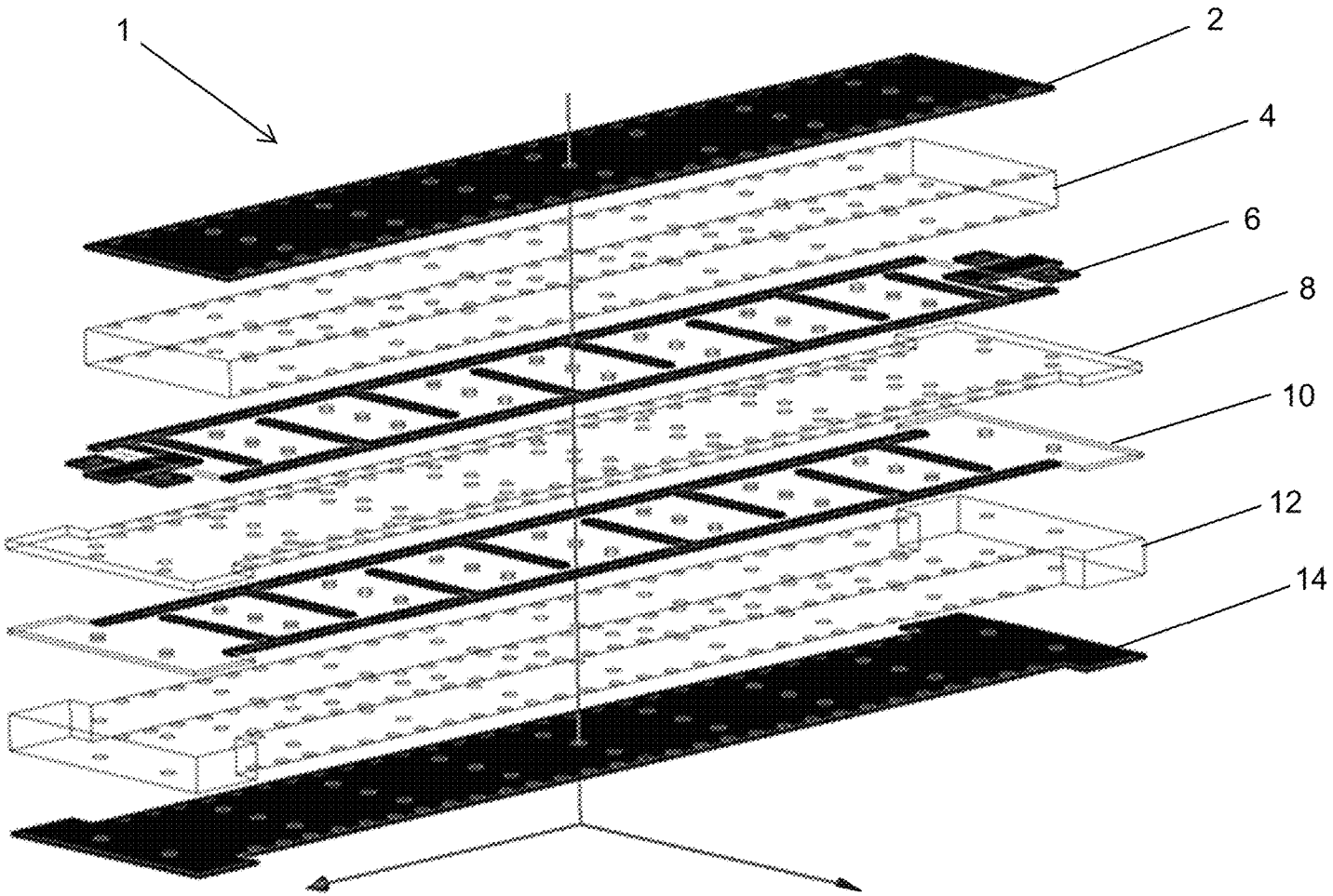
FIG. 1A shows an exploded perspective view of one embodiment of a narrowband filter having interdigital topology of the present disclosure.

Referring to FIG. 1A, an exploded perspective view of one embodiment of a narrowband filter having interdigital topology of the present disclosure is shown. More particularly, the LTCC coupled stripline narrowband filter 1 is comprised of seven layers. The top 2 and bottom 14 ground layers (or first and seventh layers) are made of metal, generally gold or silver, and range in thickness from about 0.0127 mm to about 0.05 mm. The second 4 and sixth 12 layers are comprised of dielectric material, including DuPont 9K7, or the like, and they are about 0.448 mm thick, or range from about 0.448 mm to about 1.008 mm thick. The middle 8, or fourth, layer is also comprised of DuPont 9K7 material, or the like, and is about 0.112 mm thick, or ranges from about 0.112 mm to about 0.224 mm thick. The pair of conductor layers, the third 6 and fifth 10 layers, is comprised of 0.05 mm thick metal, typically gold or silver, and dielectric material, including DuPont 9K7, or the like. It was found that thicker metal improved the filter loss—so an increase in the metal thickness went from about 0.0127 mm to about 0.05 mm with improved results. In certain embodiments, the metallization of gold was preferred over the use of silver. At microwave frequencies, silver can get corroded over time so gold is preferred even though silver has better conductivity.

Figure 1B:
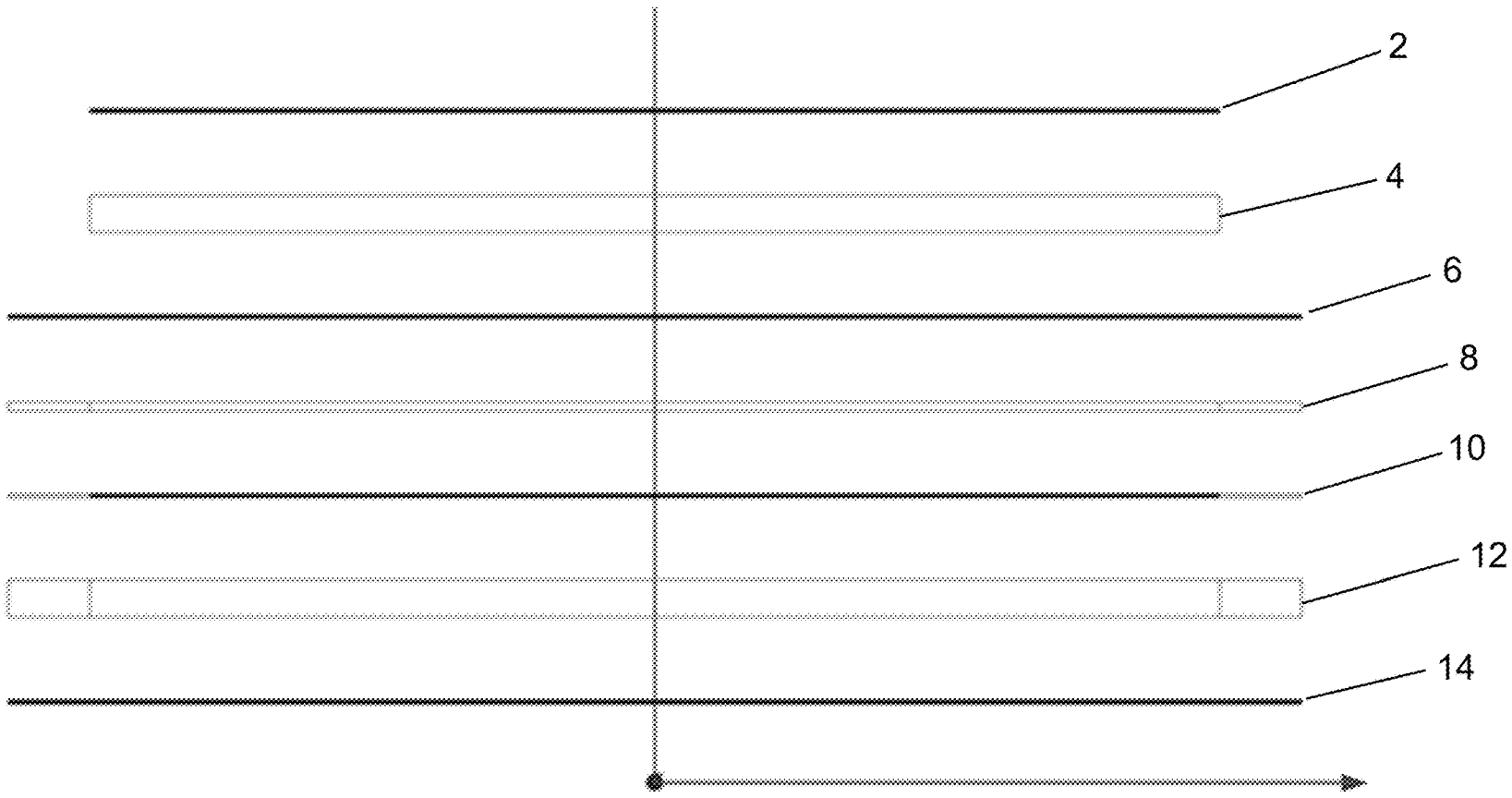
FIG. 1B shows an exploded side view of the embodiment of a narrowband filter having interdigital topology as shown in FIG. 1A.

Referring to FIG. 1B, an exploded side view of the embodiment of a narrowband filter having interdigital topology as shown in FIG. 1A is shown. More particularly, the narrowband filter has a series of layers, here seven, that vary in thickness, composition, and dimensions depending on the frequency. The dielectric material thickness is optimized to push high in frequency ceramic higher order modes. A series of vias (30, 32, 40) as shown in each of the following individual layers range in diameter from greater than or equal to 0.1803 mm to less than or equal to 0.3429 mm. The vias need to be as small in diameter and as close to each other as possible, but are limited by current manufacturing processes. In certain embodiments, all of the vias are through plated.

Figure 2A:
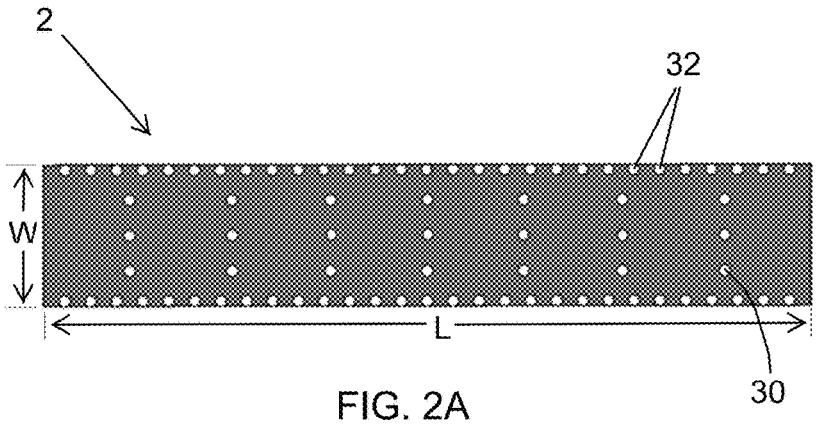
FIG. 2A shows one embodiment of a first layer of the narrowband filter having interdigital topology as shown in FIG. 1A.

FIG. 2A shows one embodiment of a first layer 2 of the narrowband filter having interdigital topology as shown in FIG. 1A. In this example, the length L of the first, ground, layer is about 13.675 mm and the width W of the first layer is about 2.53 mm. Vias 30 are located in the spacing between the various poles, or resonators (not shown), as well as other vias 32 located along the long edges of the filter. The width W is frequency dependent and the length L is filter bandwidth dependent. For a narrowband filter, the spacing between two adjacent resonators and a row of vias at mid-point between those resonators sets the required coupling to tune the filter. The coupling bandwidth required between two adjacent resonators to tune the filter sets the spacing between them. The electrical performance between two adjacent resonators dictates the mechanical spacing between them.

The number of poles, or resonators, is filter rejection dependent. Higher rejections occur with higher order of poles, but the filter insertion losses for the filter degrade with a higher number of poles. In certain embodiments, eight poles were preferred, but the design can be implemented with from about four poles to about fourteen poles.

Figure 2B:
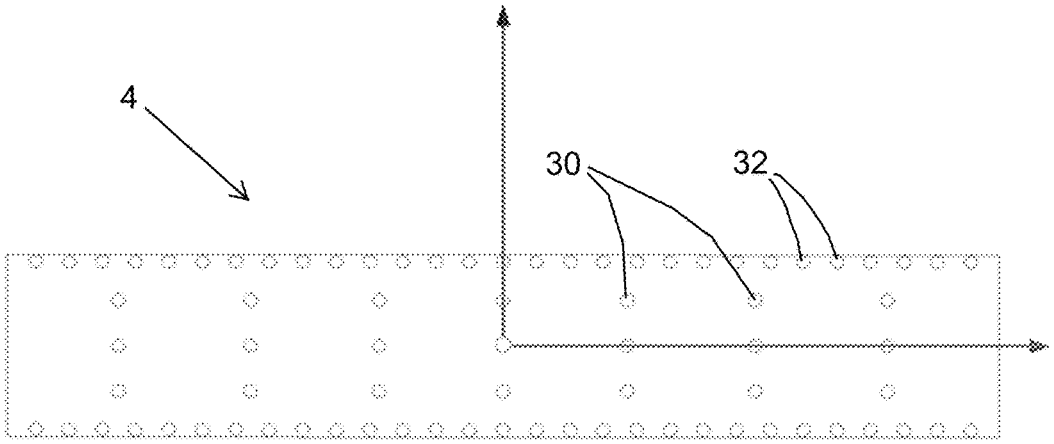
FIG. 2B shows one embodiment of a second layer of the narrowband filter having interdigital topology as shown in FIG. 1A.

FIG. 2B shows one embodiment of a second 4, dielectric, layer of the narrowband filter having interdigital topology as shown in FIG. 1A. In this example, the length of the second layer is about 13.675 mm and the width of the second layer is about 2.53 mm.

Figure 2C:
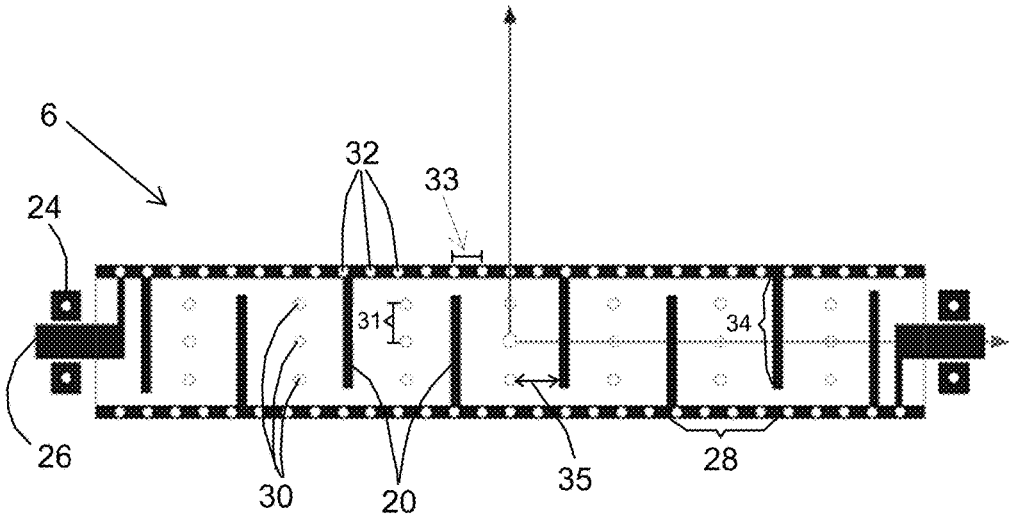
FIG. 2C shows one embodiment of a third layer of the narrowband filter having interdigital topology as shown in FIG. 1A.

FIG. 2C shows one embodiment of a third 6, conductor, layer of the narrowband filter having interdigital topology as shown in FIG. 1A. Here, the conductive layer comprises eight parallel aligned poles 20 arranged with an interdigital topology. The overall length of the third layer is about 16.675 mm and the width of the third layer is about 2.53 mm. The size of each pole is about 1.91 mm long 34 and about 0.15 mm wide and they are spaced by a distance 28 of about 1.6 mm along the length of the layer setting the required coupling between the two resonators. The vias are located along the long edge 32 of the narrowband filter are spaced 33 about 0.46 mm from each other. Other vias 30 are located in between adjacent parallel poles and are spaced from each other 31 by about 0.63 mm and are spaced about halfway between adjacent resonators 35. The vias extend from the first 2, ground, layer to the seventh 14, ground, layer. Each resonator (pole) must resonate at the specific frequency in order for the filter to be tuned. Each resonator length and width is adjusted to provide that resonance frequency. The width is set to about 0.15 mm and the length is slightly different to achieve the resonance frequency for each resonator. In this disclosure the filters are designed for a symmetrical response so the resonance frequencies are symmetrical from the center of the filter.

Figure 1C:
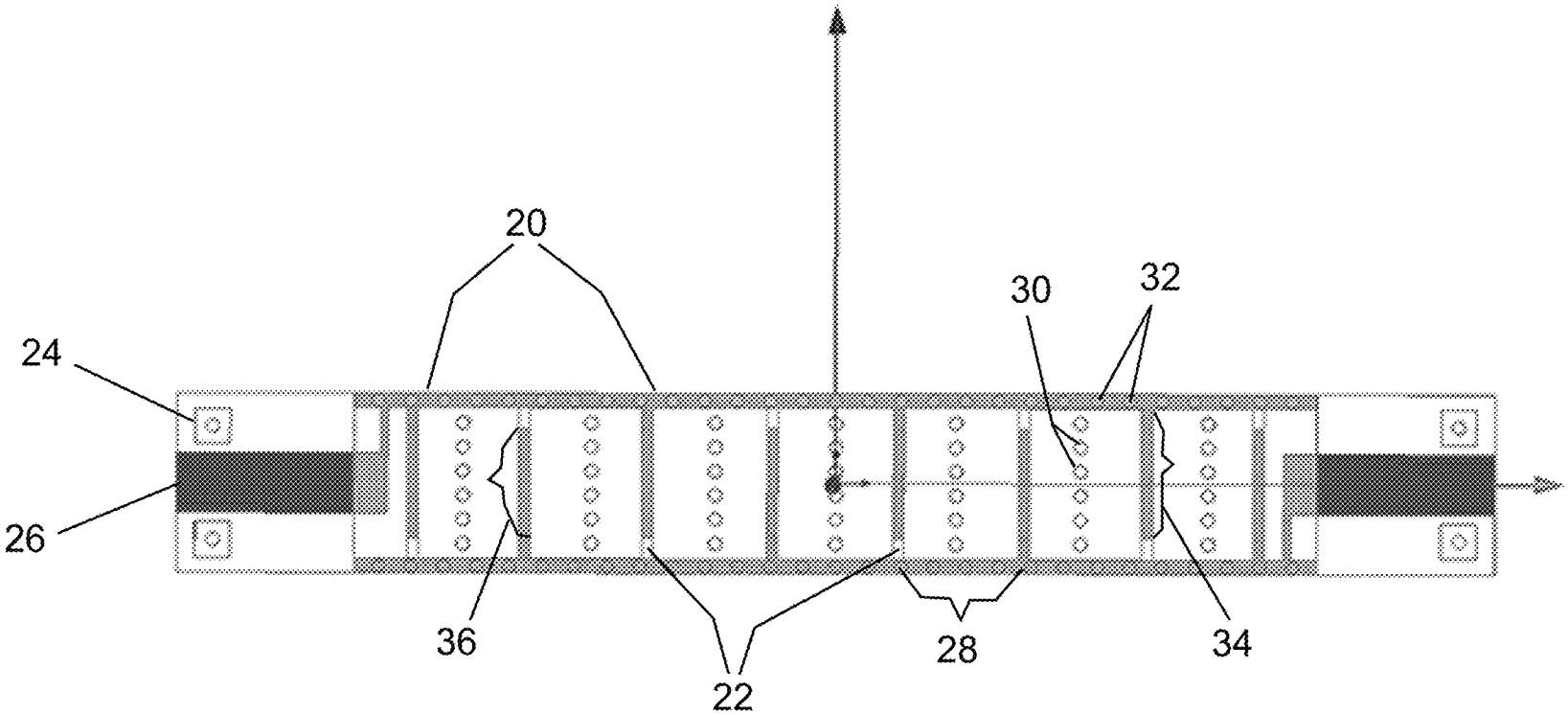
FIG. 1C shows a perspective top view of some of the assembled layers of the embodiment of a narrowband filter having interdigital topology as shown in FIG. 1A.

Still referring to FIG. 2C, the poles 20 have an actual length 34, and as can be seen in FIG. 1C, an overlap length 36. The spacing between poles within a layer 28, the spacing between conductive layers (e.g., the thickness of the fourth layer) and the spacing of the vias (31, 33, 35) all affect the properties of the filter.

Figure 2D:
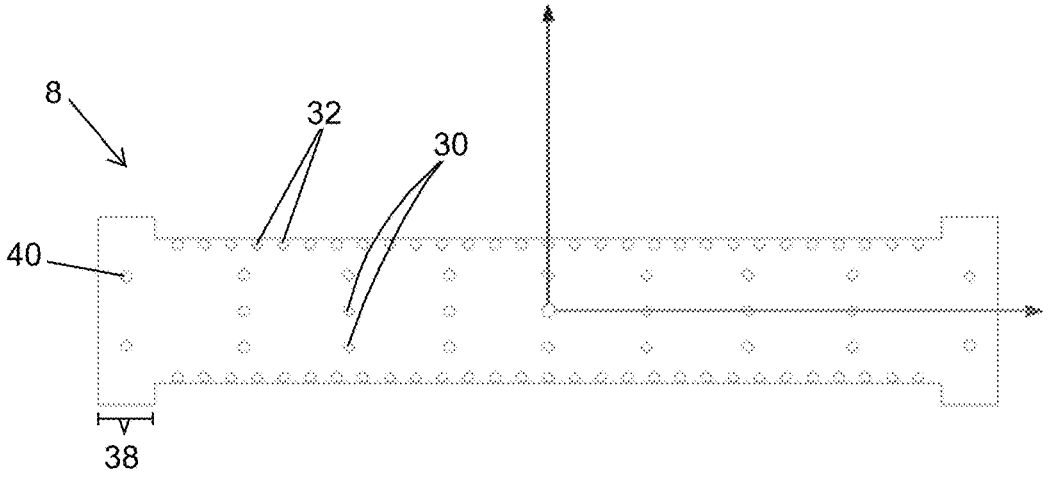
FIG. 2D shows one embodiment of a fourth layer of the narrowband filter having interdigital topology as shown in FIG. 1A.

FIG. 2D shows one embodiment of a fourth 8, dielectric, layer of the narrowband filter having interdigital topology as shown in FIG. 1A. The overall length of the fourth layer is about 16.675 mm. A first and second end of the fourth layer has a width of about 3.28 mm for about 1 mm (38) and the width in the remaining central portion of the layer is about 2.53 mm. This wider portion supports 50 OHM lines in and out of the filter ground metallization for ground-signal-signal probe. In this example, all of the vias are through plated.

Figure 2E:
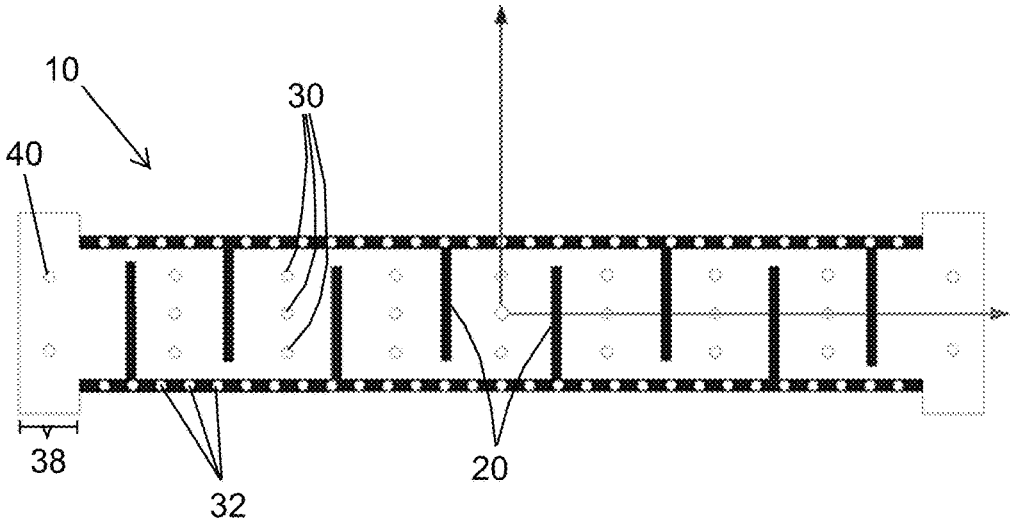
FIG. 2E shows one embodiment of a fifth layer of the narrowband filter having interdigital topology as shown in FIG. 1A.

FIG. 2E shows one embodiment of a fifth 10, conductor, layer of the narrowband filler having interdigital topology as shown in FIG. 1A. Here, the conductive layer comprises eight parallel aligned poles 20 arranged with an interdigital topology. The overall length of the fifth layer is about 16.675 mm. A first and second end of the fifth layer has a width of about 3.28 mm for about 1 mm (38) and the width in the remaining central portion of the layer is about 2.53 mm. The fifth conductive layer 10 is complimentary to the conductive layer found in the third layer 6 to form the interdigital configuration where the poles 20 do not completely overlap with a corresponding pole over the entire length of each pole, as shown in FIG. 1C. The poles on the two conductive layers are parallel aligned. Thus, the poles have an actual length 34 and an overlap length 36 with respect to a corresponding pole. In FIG. 1C, the overlay of the layers can be seen such that the poles are parallel aligned within a layer and between layers, but each pole is slightly offset, lengthwise with respect to the pole below it. The parallel aligned strips on FIG. 2C and on FIG. 2E are coupled to form the coupled stripline resonator. Each resonator is made up of two strips. A first strip is on FIG. 2C and the second strip is on FIG. 2E and the paired strips are shorted at the opposing ends. This coupling between the two strips significantly reduces the length of the resonator, and ultimately, the size of the filter.

Figure 2F:
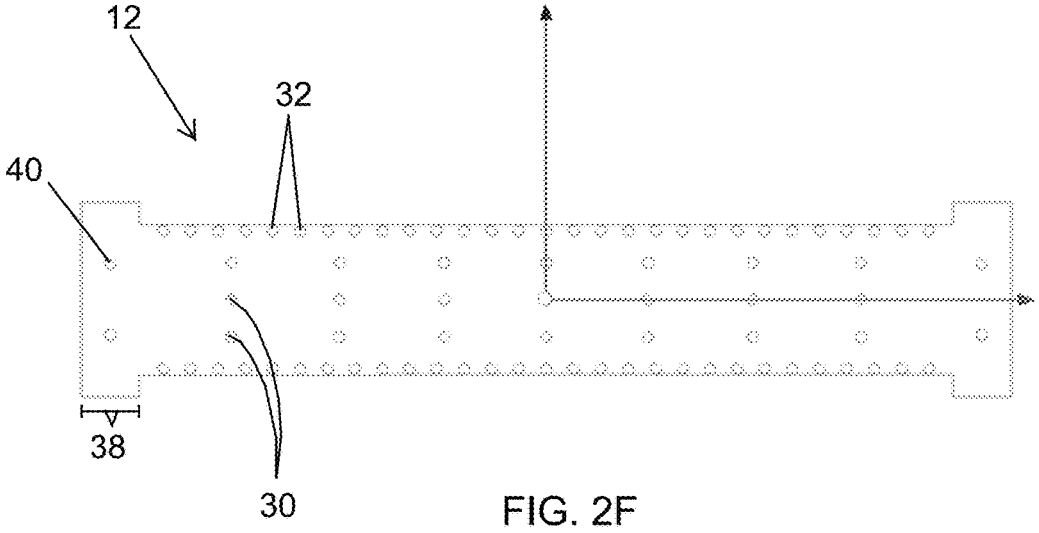
FIG. 2F shows one embodiment of a sixth layer of the narrowband filter having interdigital topology as shown in FIG. 1A.

FIG. 2F shows one embodiment of a sixth, dielectric, layer 12 of the narrowband filter having interdigital topology as shown in FIG. 1A. The overall length of the sixth layer is about 16.675 mm. A first and second end of the sixth layer has a width of about 3.28 mm for about 1 mm (38) and the width in the remaining central portion of the layer is about 2.53 mm. The series of vias in this layer align with vias in other layers (40, 30, 32) as they are through plated vias that connect the first layer 2 with the seventh layer 14. To create an "electric wall" to decouple the various resonators, poles 20.

Figure 2G:
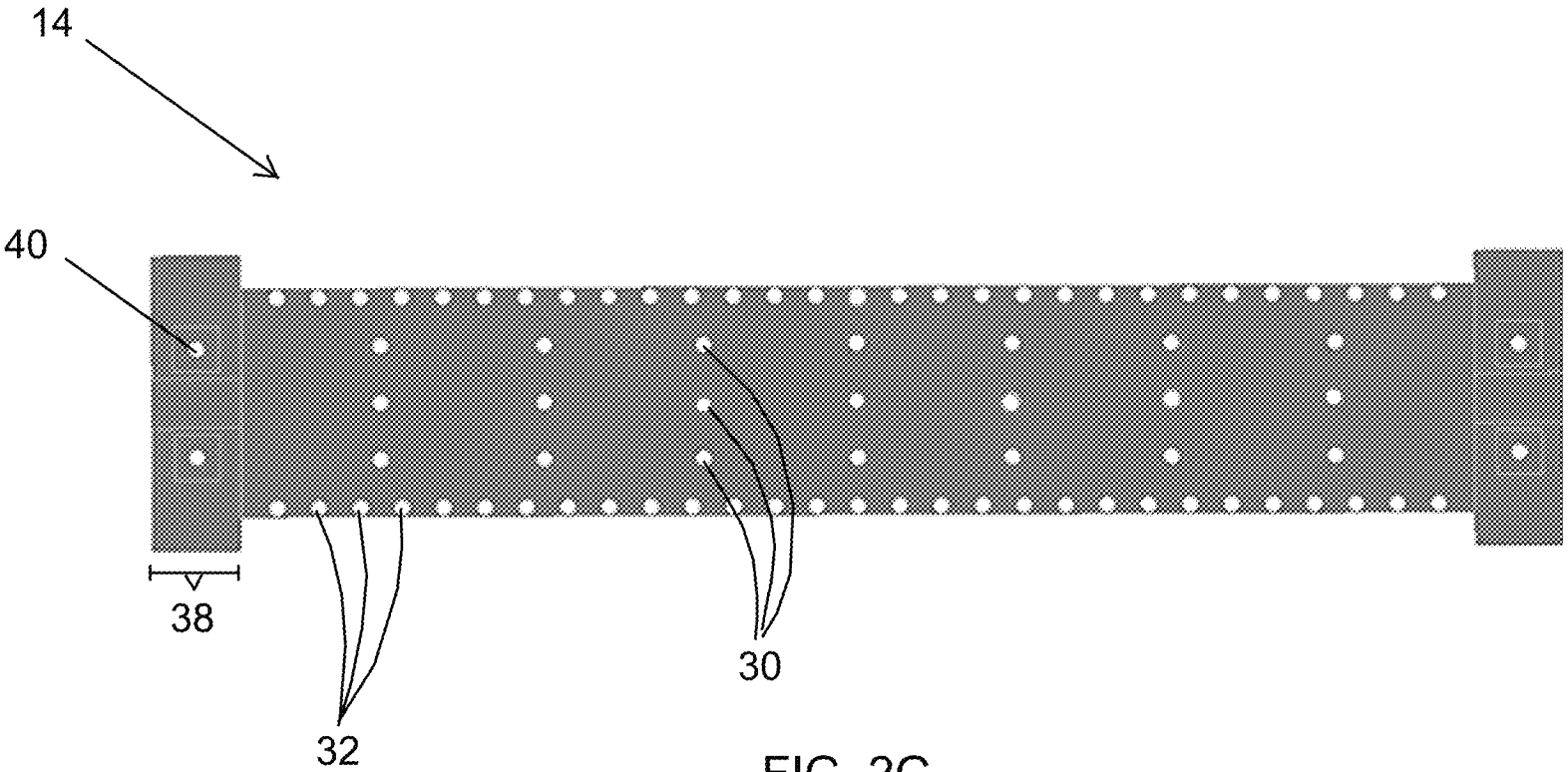
FIG. 2G shows one embodiment of a seventh layer of the narrowband filter having interdigital topology as shown in FIG. 1A.

FIG. 2G shows one embodiment of a seventh, ground, layer 14 of the narrowband filter having interdigital topology as shown in FIG. 1A. The overall length of the seventh layer is about 16.675 mm. A first and second end of the seventh layer has a width of about 3.28 mm for about 1 mm (38) and the width in the remaining central portion of the layer is about 2.53 mm. Layers 2 and 14 are the top and bottom ground layers of metallization, and are connected to each other by through plated vias.

TABLE 1

| Narrowband filters (0.3 GHz bandwidth) | | | | |
|---|---|---|---|---|
| Center Frequency/ Filter Topology | Bandwidth | Insertion loss at center frequency | Filter size | Filter Performance |
| 8.2 GHz Interdigital Filter | 0.3 GHz | 5.95 dB | Height = 1.7 mm Width = 2.6 mm Length = 18.6 mm | FIG. 7A-FIG. 7D |
| 10.2 GHz Interdigital Filter | 0.3 GHz | 6.65 dB | Height = 1.7 mm Width = 2.9 mm Length = 19.6 mm | FIG. 8A-FIG. 8D |
| 11.8 GHz Interdigital Filter | 0.3 GHz | 7.05 dB | Height = 1.7 mm Width = 2.7 mm Length = 20.3 mm | FIG. 9A-FIG. 9D |

Some exemplary narrowband filters are shown in Table 1, above. There, the filters had 0.3 GHz bandwidth and a range of center frequencies and, as such, are well suited for use in applications such as in digital receivers with high order Nyquist sampling, direct digital sampling of radar, and communications phased arrays at element level spacing.

These narrowband filters had interdigital topology and smaller overall size, as compared to conventional narrowband filters, and ranged in length from about 18 mm to about 21 mm. The length of the filter is bandwidth dependent. It gets longer with smaller bandwidths and has a limitation related to the decoupling vias. Certain embodiments ranged in height from about 1.5 mm to about 2 mm, and ranged in width from about 2.5 mm to about 3 mm. The filter height is a design parameter and is a tradeoff between inter-resonator coupling and higher order ceramic modes.

Additionally, as noted in Table 1, the plots of the performance for the various exemplary narrowband filters will be discussed in more detail in FIG. 7A-FIG. 7D, FIG. 8A-FIG. 8D, and FIG. 9A-FIG. 9D, respectively, following the physical description for the various exemplary broadband filters.

Figure 3A:
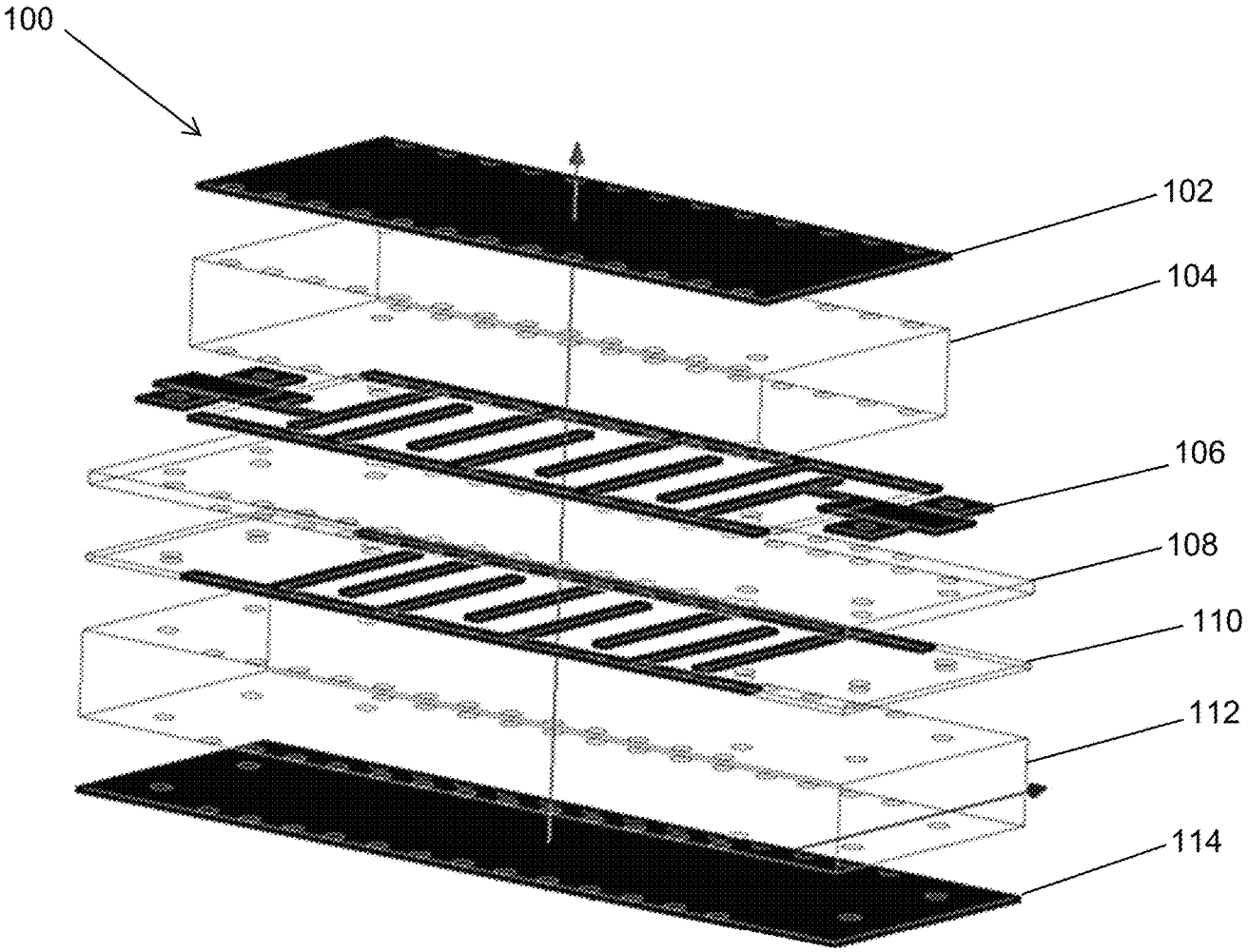
FIG. 3A shows an exploded perspective view of one embodiment of a broadband filter having interdigital topology of the present disclosure.

FIG. 3A shows an exploded perspective view of one embodiment of a broadband filter having interdigital topology of the present disclosure. More specifically, the LTCC coupled stripline broadband filter 100 is comprised of seven layers. The top 102 and bottom 114 ground (or first and seventh layers) are made of metal, generally gold or silver, and range in thickness from about 0.0127 mm to about 0.05 mm. The second 104 and sixth 112 layers are comprised of dielectric material, including DuPont GreenTape™ 9K7, or the like, and are about 0.756 mm thick, or range from about 0.448 mm to about 1.008 mm thick. The middle, or fourth 108, layer is also comprised of DuPont GreenTape™ 9K7 material, or the like, and is about 0.112 mm thick, or ranges from about 0.112 mm to about 0.224 mm thick. The conductor layers, the third 106 and the fifth 110 layers, are comprised of 0.05 mm thick metal, typically gold or silver, and dielectric material. It was found that thicker metal improved the filter losses—so an increase in the metal thickness went from about 0.0127 mm to about 0.05 mm. In certain embodiments, the metallization of gold was preferred over the use of silver. The main difference with FIG. 1A is the inductive input coupling structure (50 OHM lines are inductively loading the input and output resonators) and the lack of decoupling vias between adjacent resonators. For broadband filters, stronger couplings are needed between adjacent resonators so there is no need for decoupling vias.

Figure 3B:
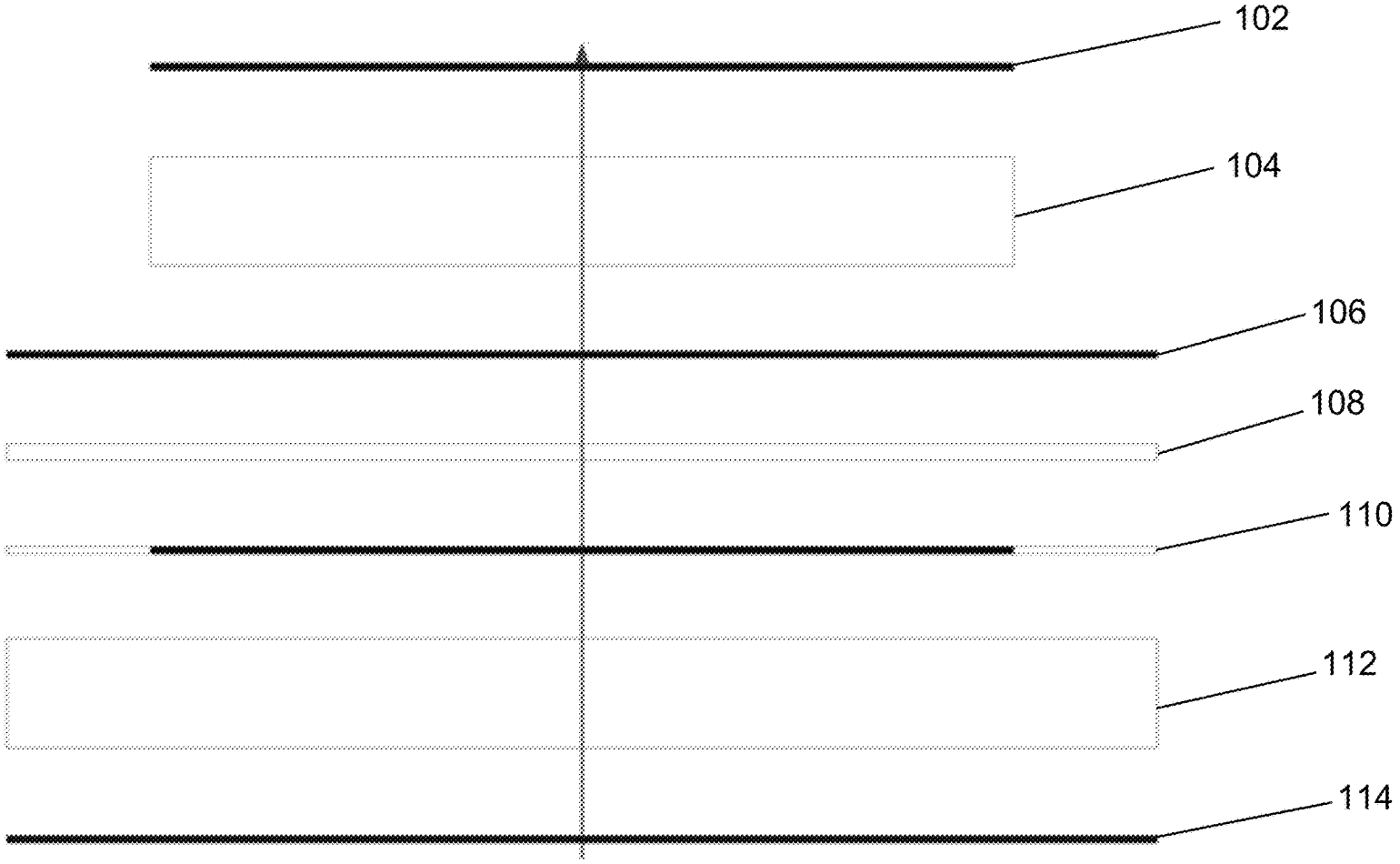
FIG. 3B shows an exploded side view of the embodiment of a broadband filter having interdigital topology as shown in FIG. 3A.

FIG. 3B shows an exploded side view of the embodiment of a broadband filter having interdigital topology as shown in FIG. 3A. More particularly, the broadband filter has a series of layers, here seven, that vary in thickness, composition, and dimensions depending on the particular application. The series of vias (130, 132, 140) as noted in each of the following individual layers range in diameter from greater than or equal to 0.1803 mm to less than or equal to 0.3429 mm. Other sized vias may be contemplated depending on the application.

Figure 4A:
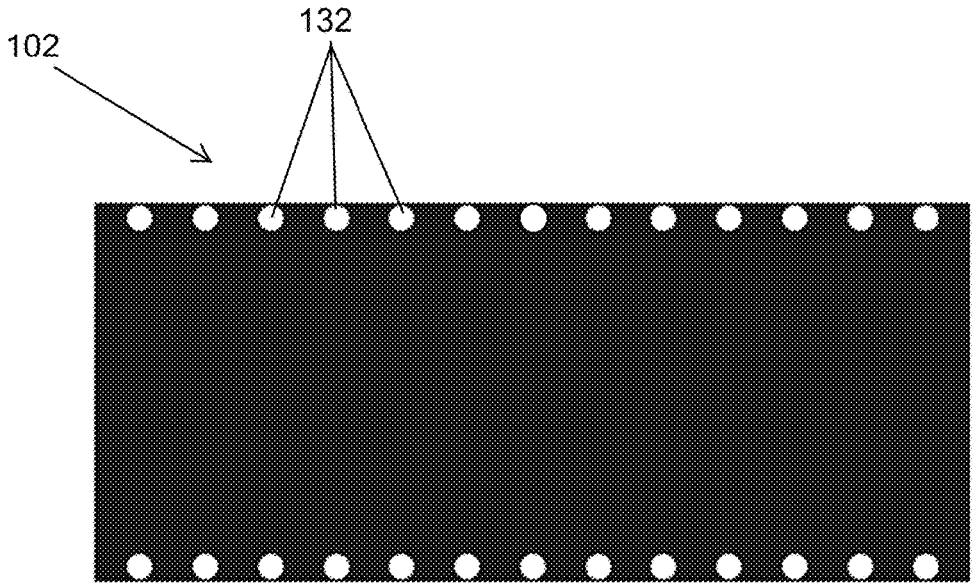
FIG. 4A shows one embodiment of a first layer of the broadband filter having interdigital topology as shown in FIG. 3A.

FIG. 4A shows one embodiment of a first, ground, layer 102 of the broadband filter having interdigital topology as shown in FIG. 3A. In this example, the length of the first layer is about 6.018 mm and the width of the first layer is about 2.6 mm. A series of vias 132 are located along the long edge of the filter and are spaced by about 0.45 mm from each other.

Figure 4B:
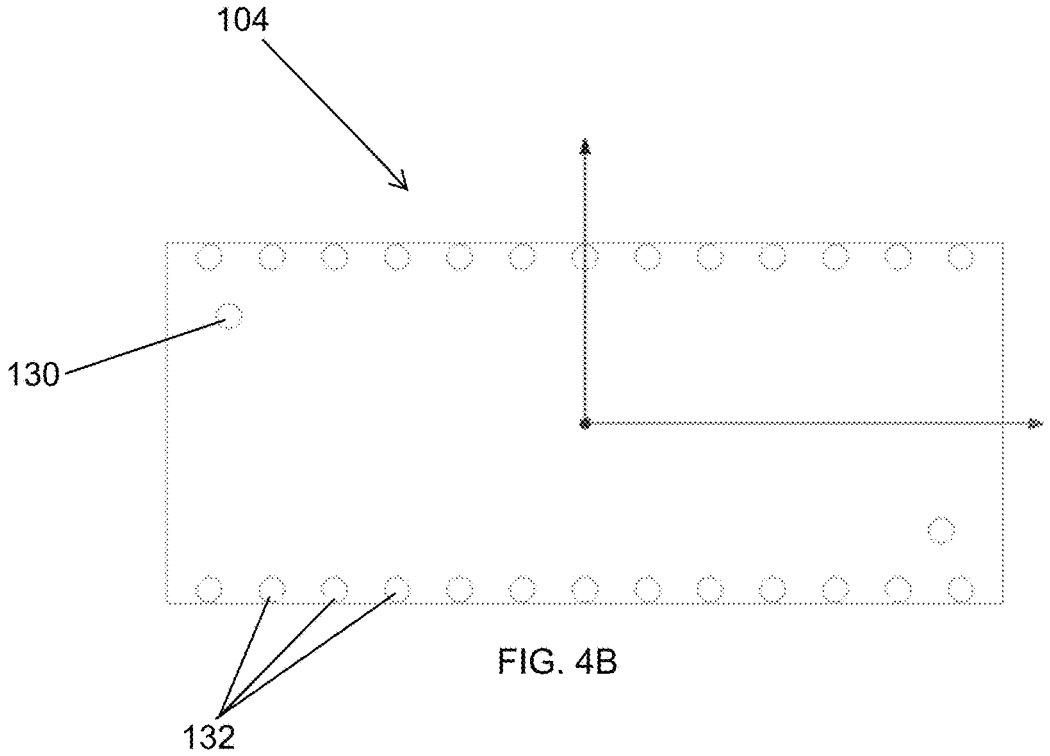
FIG. 4B shows one embodiment of a second layer of the broadband filter having interdigital topology as shown in FIG. 3A.

FIG. 4B shows one embodiment of a second 104, dielectric, layer of the broadband filter having interdigital topology as shown in FIG. 3A. In this example, the length of the second layer is about 6.018 mm and the width of the second layer is about 2.6 mm.

Figure 4C:
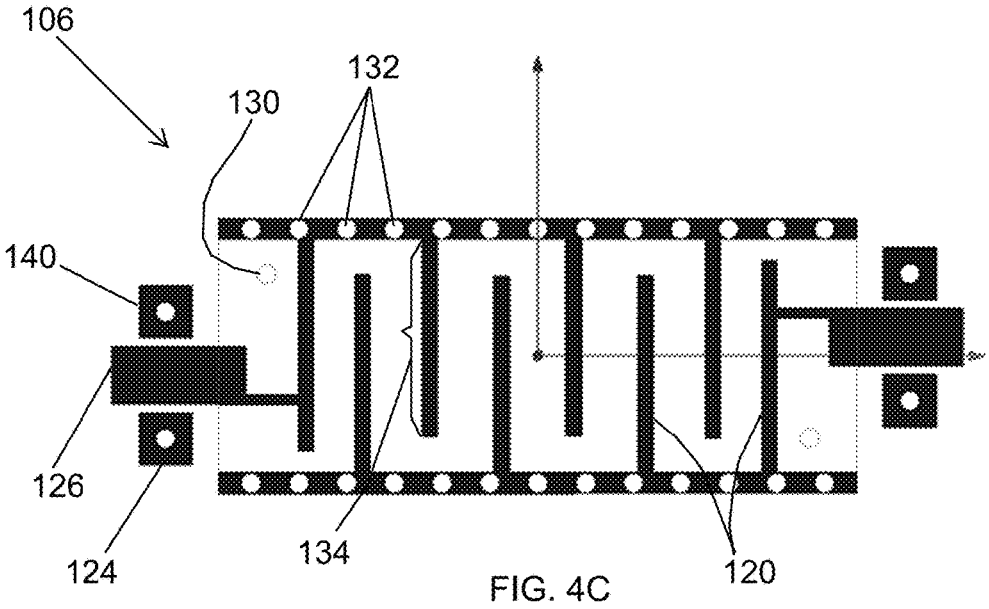
FIG. 4C shows one embodiment of a third layer of the broadband filter having interdigital topology as shown in FIG. 3A.

FIG. 4C shows one embodiment of a third 106, conductor, layer of the broadband filter having interdigital topology as shown in FIG. 3A. Here, the conductive layer comprises eight parallel aligned poles 120, or resonators, arranged with an interdigital topology. The overall length of the third layer is about 8.018 mm and the width is about 2.6 mm. The size of each pole 120 is about 1.857 mm long 134 and about 0.15 mm wide. The poles are spaced apart by a distance 128 of about 0.676 mm along the length of the filter. The vias 132 are located only along the long edge of the filter and not in between pairs of poles. The vias 132 are spaced 133 about 0.45 mm apart along the length of the filter and are through plated.

Figure 4D:
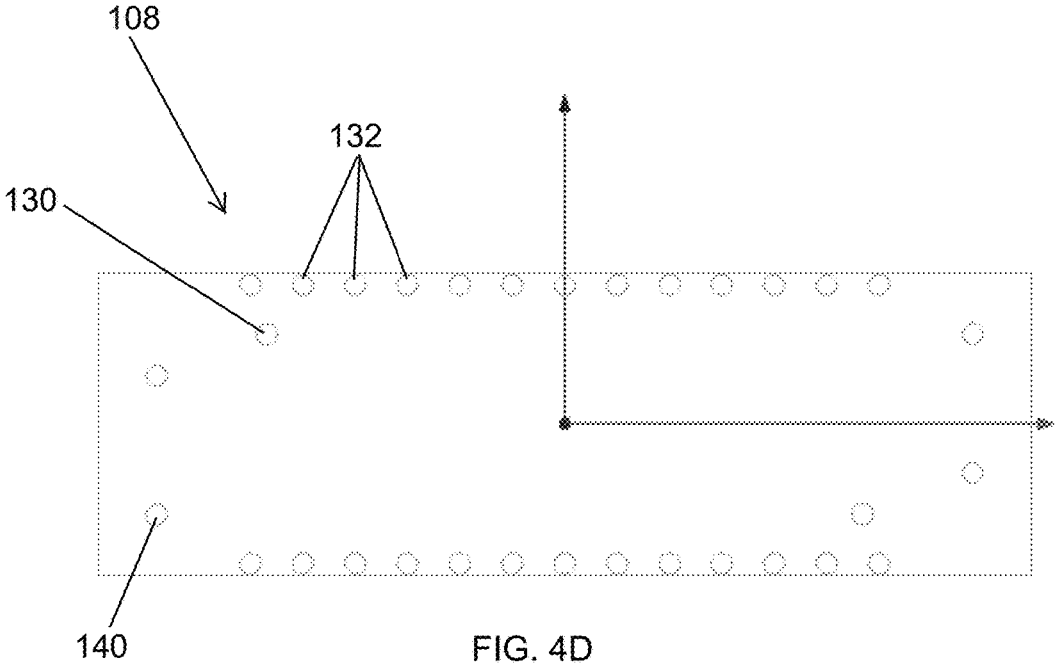
FIG. 4D shows one embodiment of a fourth layer of the broadband filter having interdigital topology as shown in FIG. 3A.

FIG. 4D shows one embodiment of a fourth 108, dielectric, layer of the broadband filter having interdigital topology as shown in FIG. 3A. The overall length of the fourth layer is about 8.018 mm and the width of the fourth layer is about 2.6 mm.

Figure 4E:
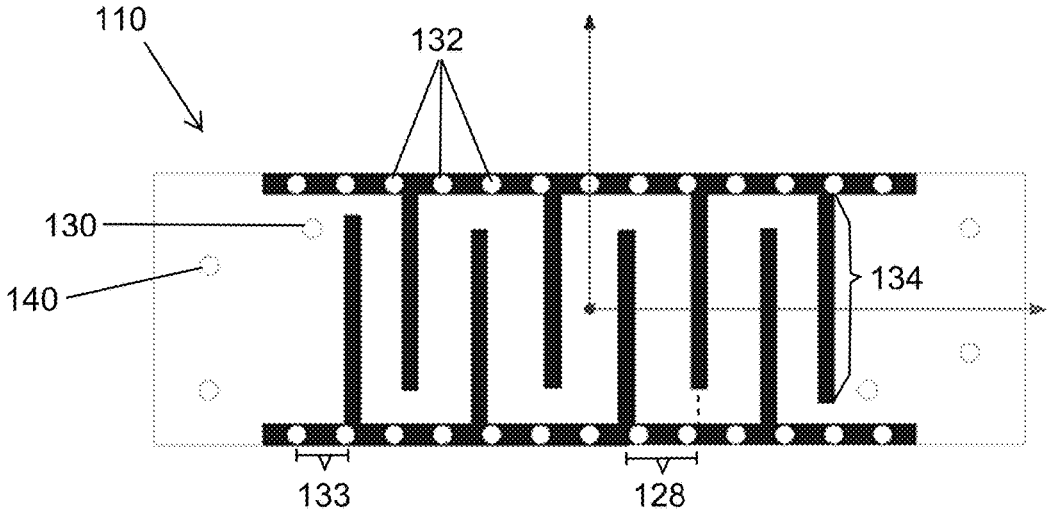
FIG. 4E shows one embodiment of a fifth layer of the broadband filter having interdigital topology as shown in FIG. 3A.

FIG. 4E shows one embodiment of a fifth 110, conductor, layer of the broadband filter having interdigital topology as shown in FIG. 3A. The overall length of the fifth layer is about 8.018 mm and the width is about 2.6 mm. The fifth conductive layer 110 is complimentary to the conductive layer found in the third layer 106 to form the interdigital configuration where the poles 120 do not completely overlap with a corresponding pole in another layer over the entire length of each pole, as best shown in FIG. 1C. There, the overlay of the layers can be seen such that the poles are parallel aligned within a layer and between the complimentary layers, but each pole is slightly offset, lengthwise with respect to the pole in another layer. The parallel aligned strips on FIG. 4C and on FIG. 4E are coupled to form the coupled stripline resonator. Each resonator is made up of two strips. A first strip is on FIG. 4C and the second strip is on FIG. 4E and they are shortened at their opposing ends. This coupling between the two strips significantly reduces the length of the resonator, and ultimately, the size of the filter.

Figure 4F:
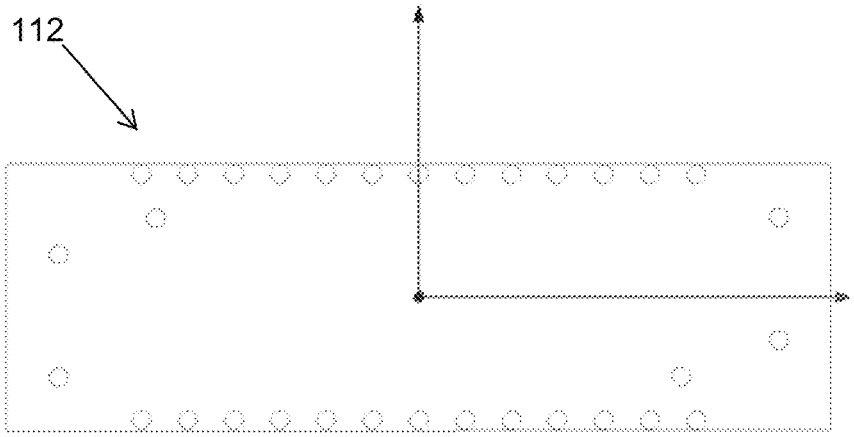
FIG. 4F shows one embodiment of a sixth layer of the broadband filter having interdigital topology as shown in FIG. 3A.

FIG. 4F shows one embodiment of a sixth 112, dielectric, layer of the broadband filter having interdigital topology as shown in FIG. 3A. The overall length of the sixth layer is about 8.018 mm and the width of the sixth layer is about 2.6 mm. The wider end on the narrowband filters does not have any significance, so long as the filter width is wide enough for 50 OHM line widths. In the case of the broadband filters examples here, the width is wide enough for 50 OHM lines with ground pads for ground-signal-ground and there is no need for wider ends.

Figure 4G:
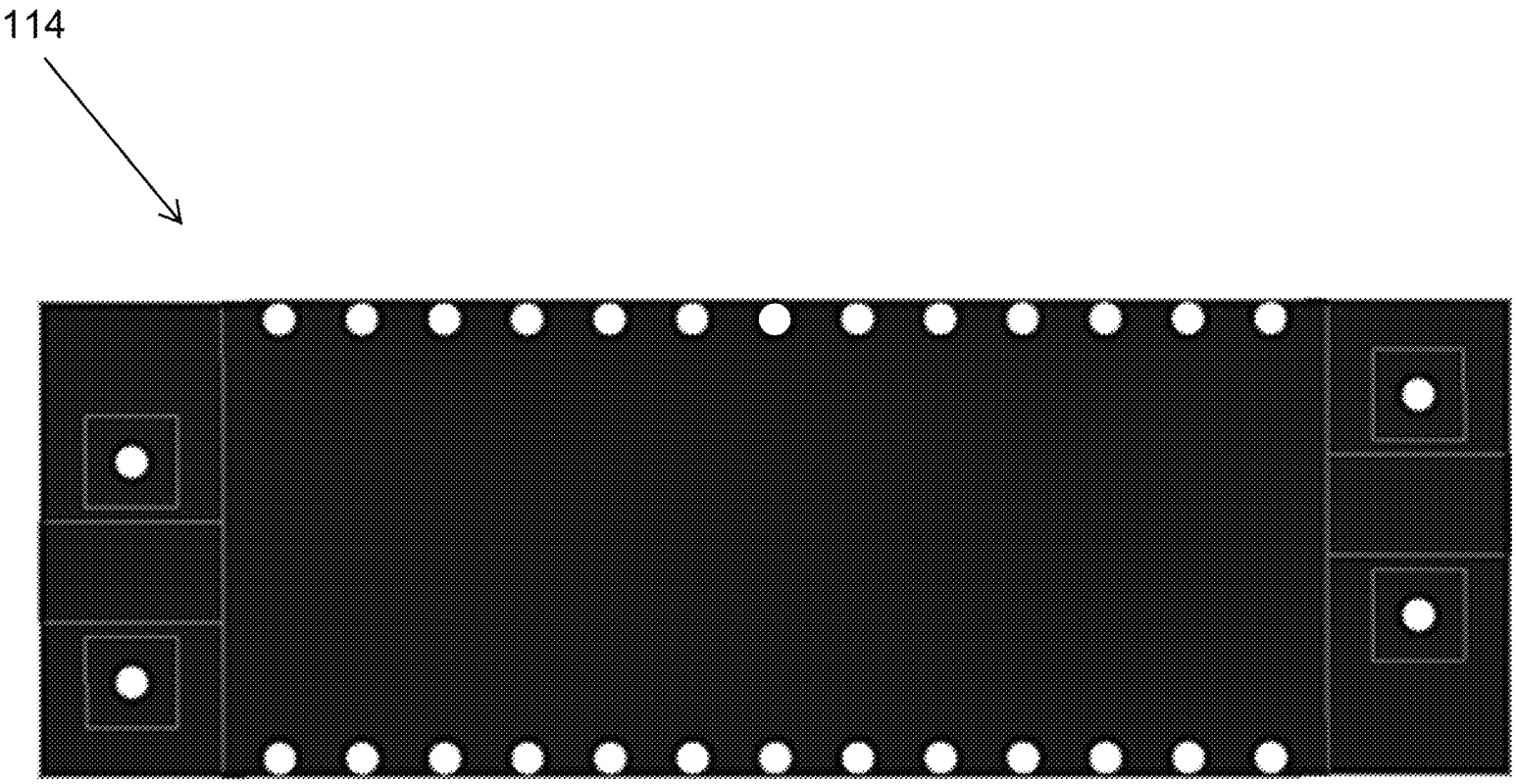
FIG. 4G shows one embodiment of a seventh layer of the broadband filter having interdigital topology as shown in FIG. 3A.

FIG. 4G shows one embodiment of a seventh 114, ground, layer of the broadband filter having interdigital topology as shown in FIG. 3A. The overall length of the seventh layer is about 8.018 mm and the width of the seventh layer is about 2.6 mm.

Figure 5A:
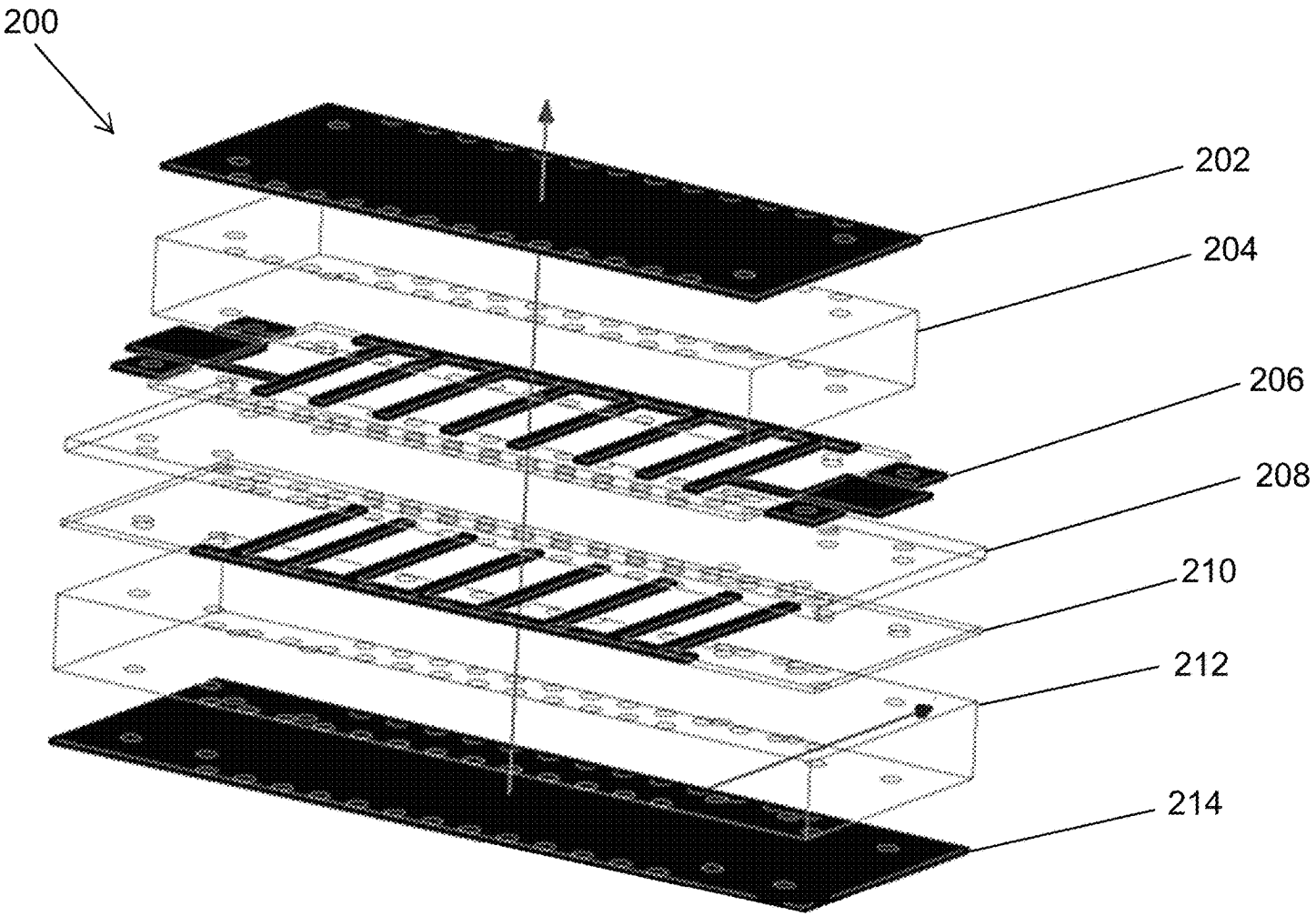
FIG. 5A shows an exploded perspective view of one embodiment of a broadband filter having combline topology of the present disclosure.

FIG. 5A shows an exploded perspective view of one embodiment of a broadband filter having combline topology of the present disclosure. More specifically, the LTCC coupled stripline broadband filter 200 is comprised of seven layers. The top 202 and bottom 214 ground layers (or first and seventh layers) are made of metal, generally gold or silver, and range in thickness from about 0.0127 mm to about 0.05 mm. The second 204 and sixth 212 layers are comprised of dielectric material, including DuPont GreenTape™ 9K7 material, or the like, and are about 0.672 mm thick, or range from about 0.448 mm to about 1.008 mm thick. The middle, or fourth 208, layer is also comprised of DuPont GreenTape™ 9K7 material, or the like, and is about 0.112 mm thick, or ranges from about 0.112 mm to about 0.224 mm thick. The conductor layers, the third 206 and the fifth 210 layers, are comprised of 0.05 mm thick metal, typically gold or silver, and dielectric material. It was found that thicker metal improved the filter losses—so an increase in the metal thickness filter insertion loss and the metal thickness went from about 0.0127 mm to about 0.05 mm. In certain embodiments, the metallization of gold was preferred over the use of silver. In this embodiment, the center frequency was 8.2 GHz and the filter bandwidth was 3 GHz.

Figure 5B:
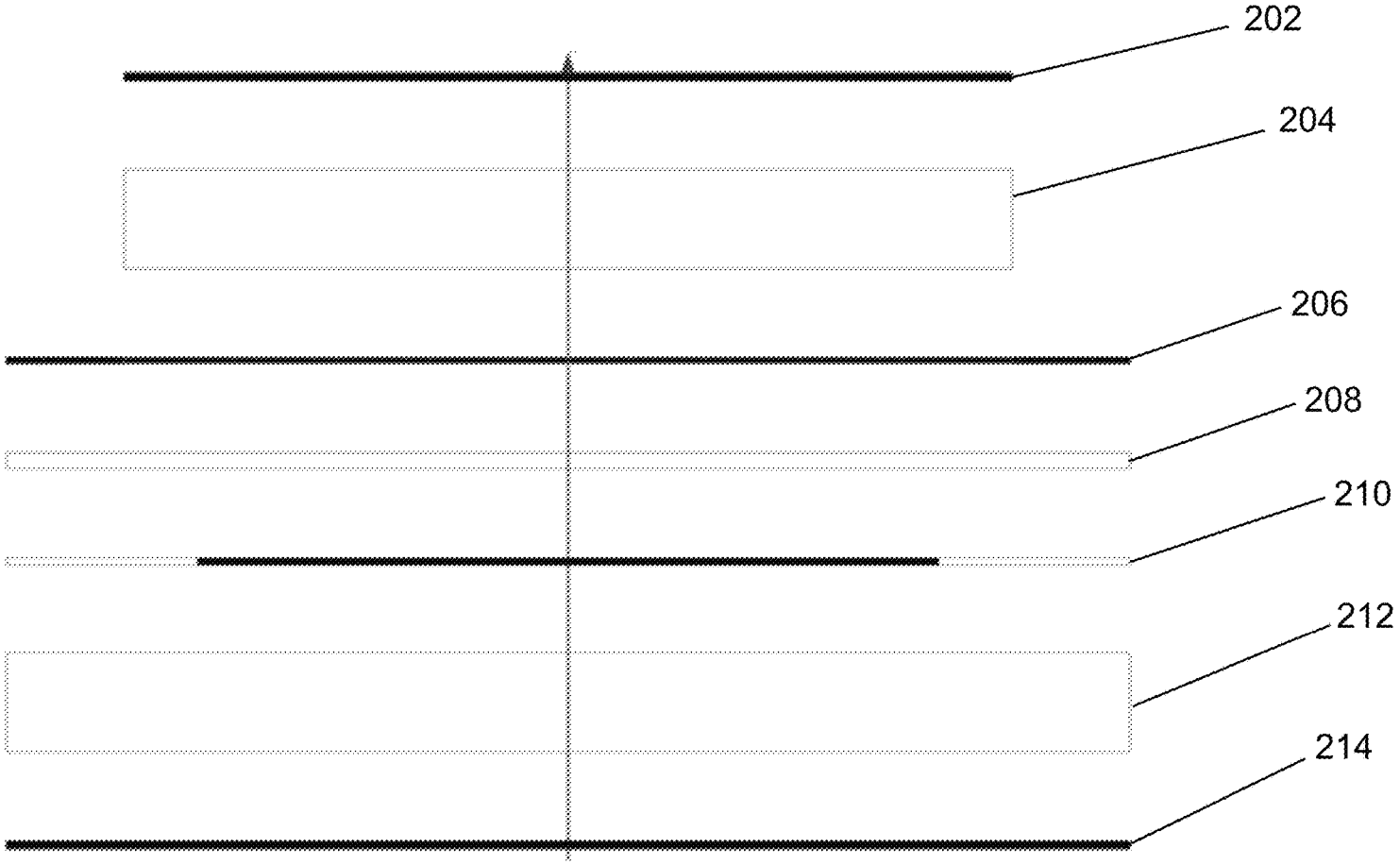
FIG. 5B shows an exploded side view of the embodiment of a broadband filter having combline topology as shown in FIG. 5A.

FIG. 5B shows an exploded side view of the embodiment of a broadband filter having combline topology as shown in FIG. 5A. More particularly, the broadband filter has a series of layers, here seven, that vary in thickness, composition, and dimensions depending on the particular application. The series of vias (230, 232, 240), as shown in each of the following individual layers range in diameter from greater than or equal to 0.1803 mm to less than or equal to 0.3429 mm.

Figure 5C:
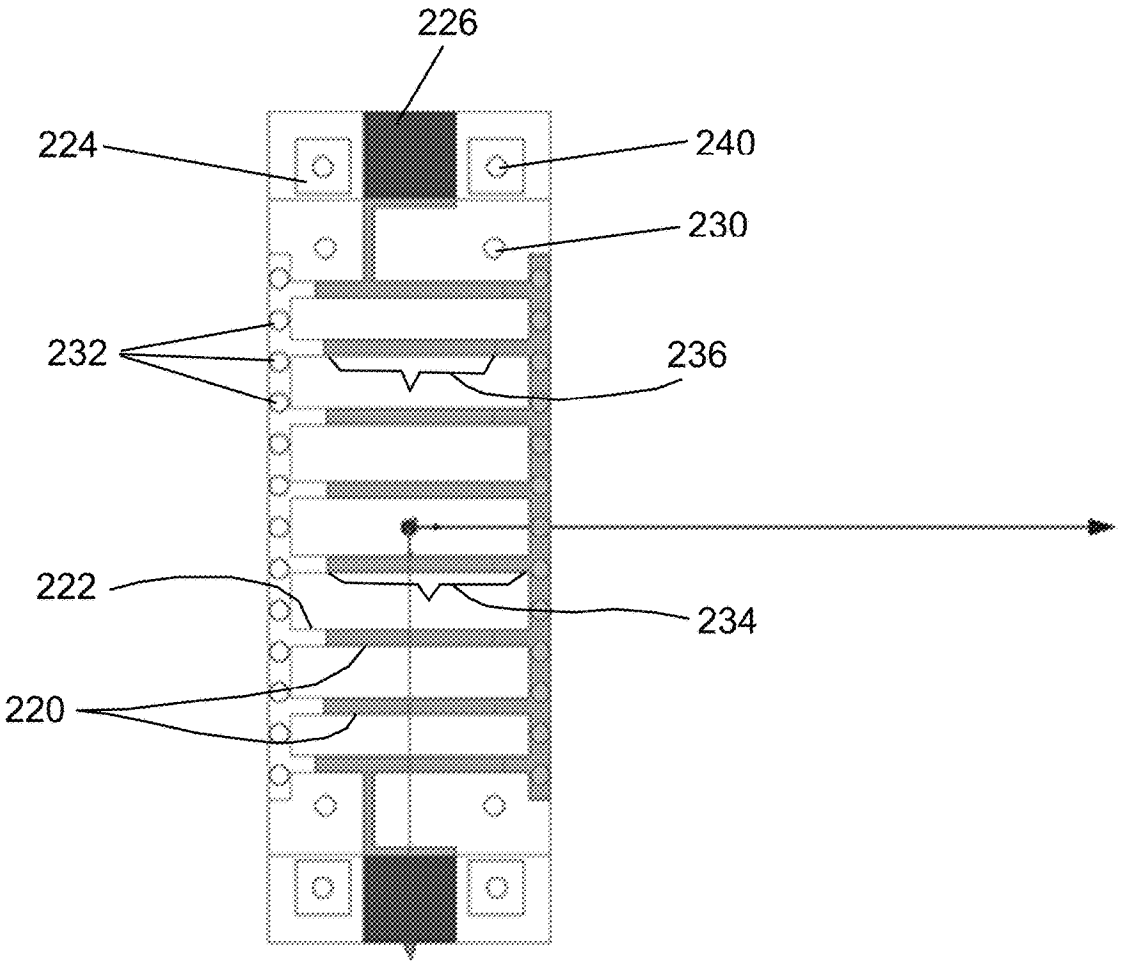
FIG. 5C shows a perspective top view of some of the assembled layers of the embodiment of the broadband filter having combline topology as shown in FIG. 5A.

FIG. 5C shows a perspective top view of some of the assembled layers of an embodiment of the broadband filter having combline topology. The fifth conductive layer 210 is complimentary to the conductive layer found in the third layer 206 to form the interdigital configuration where the poles 220 do not completely overlap with a corresponding pole over the entire length of each pole. The poles 220 on the two conductive layers are parallel aligned. Thus, the poles have an actual length 234 and an overlap length 236 with respect to a corresponding pole. In FIG. 5C, the overlay of the layers can be seen such that the poles are parallel aligned within a layer and between layers, but each pole is slightly offset, lengthwise 222 with respect to the pole below it.

Figure 6A:
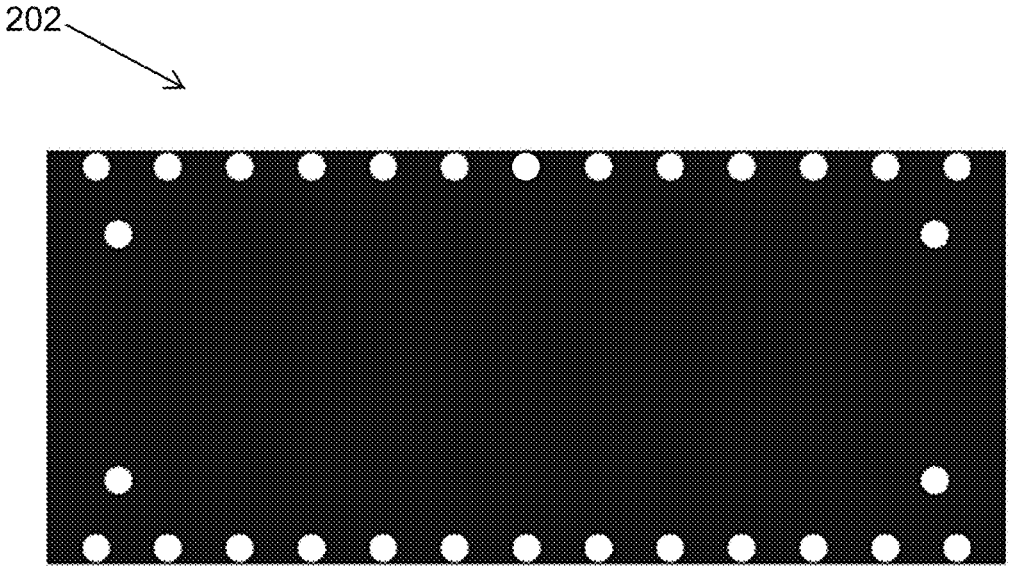
FIG. 6A shows one embodiment of a first layer of the broadband filter having combline topology as shown in FIG. 5A.
Figure 6B:
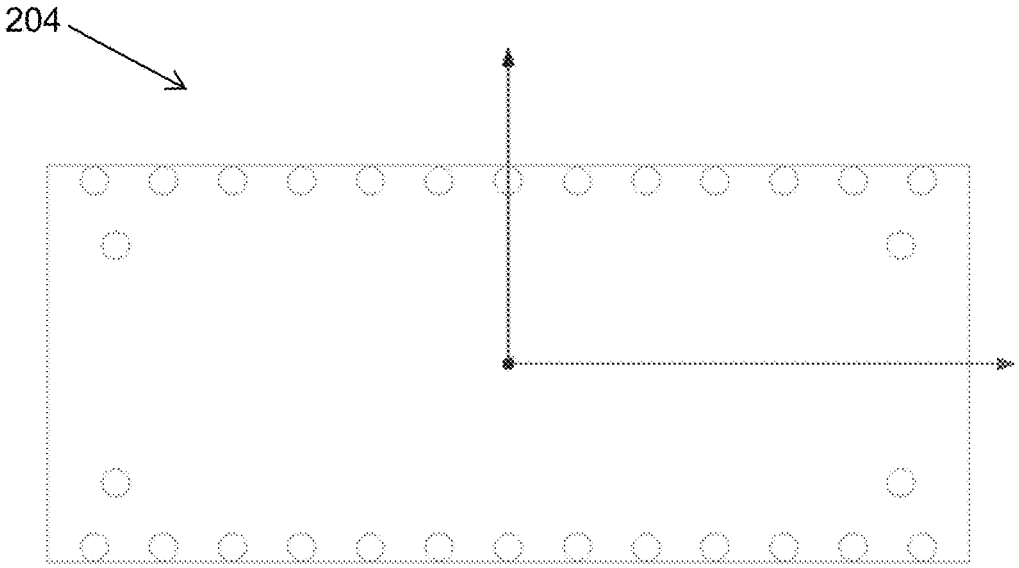
FIG. 6B shows one embodiment of a second layer of the broadband filter having combline topology as shown in FIG. 5A.

FIG. 6A shows one embodiment of a first 202, ground, layer of the broadband filter having combline topology as shown in FIG. 5A. In this example, the length of the first layer is about 6.018 mm and the width of the first layer is about 2.6 mm FIG. 6B shows one embodiment of a second 204, dielectric, layer of the broadband filter having combline topology as shown in FIG. 5A. In this example, the length of the second layer is about 6.018 mm and the width of the second layer is about 2.6 mm.

Figure 6C:
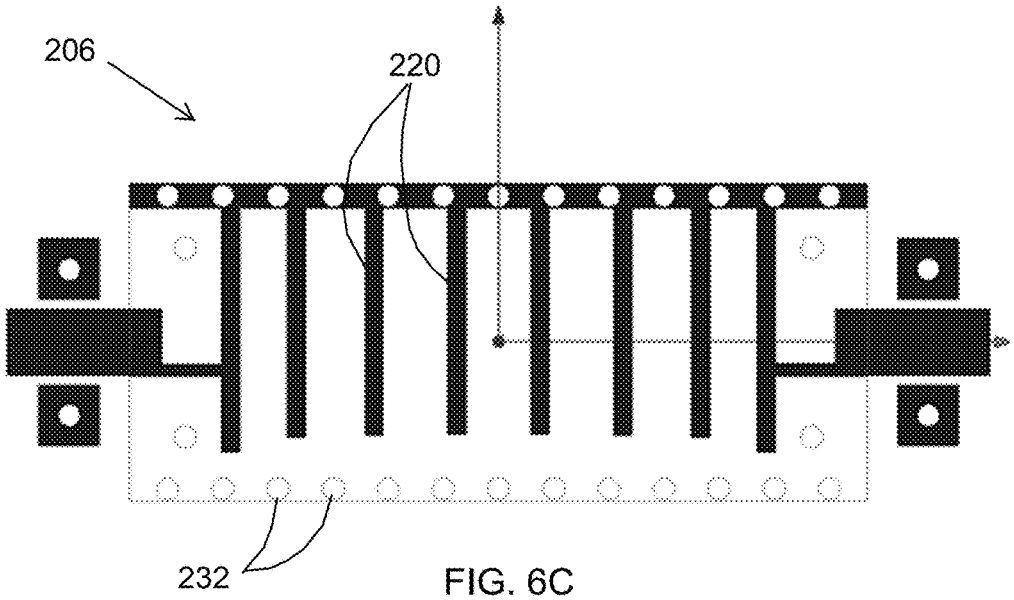
FIG. 6C shows one embodiment of a third layer of the broadband filter having combline topology as shown in FIG. 5A.

FIG. 6C shows one embodiment of a third 206, conductor, layer of the broadband filter having combline topology as shown in FIG. 5A. Here, the conductive layer comprises eight parallel aligned poles 220 arranged with a combline topology. The overall length of the third layer is about 8.018 mm and the width of the third layer is about 2.6 mm. The size of each pole 220 is about 1.858 mm long and about 0.15 mm wide and the poles are spaced by a distance of about 0.706 mm along the length of the filter. The vias 232 are located only along the long edge of the filter and are spaced about 0.38 mm from each other. For manufacturing, the layers are made individually and assembled together through LTCC technology manufacturing process.

Figure 6D:
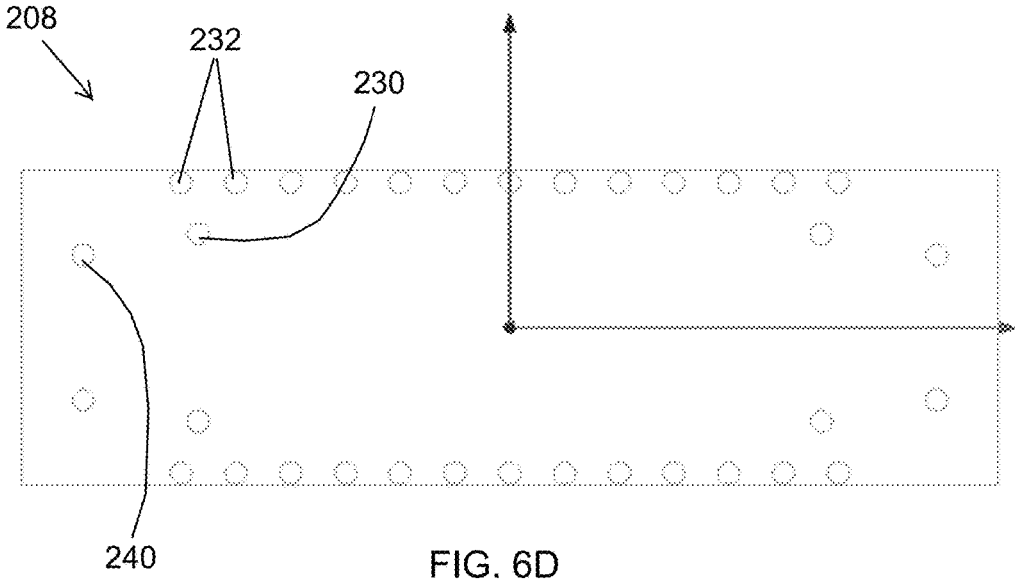
FIG. 6D shows one embodiment of a fourth layer of the broadband filter having combline topology as shown in FIG. 5A.

FIG. 6D shows one embodiment of a fourth 208, dielectric, layer of the broadband filter having combline topology as shown in FIG. 5A. In this example, the length of the fourth layer is about 8.018 mm and the width of the fourth layer is about 2.6 mm.

Figure 6E:
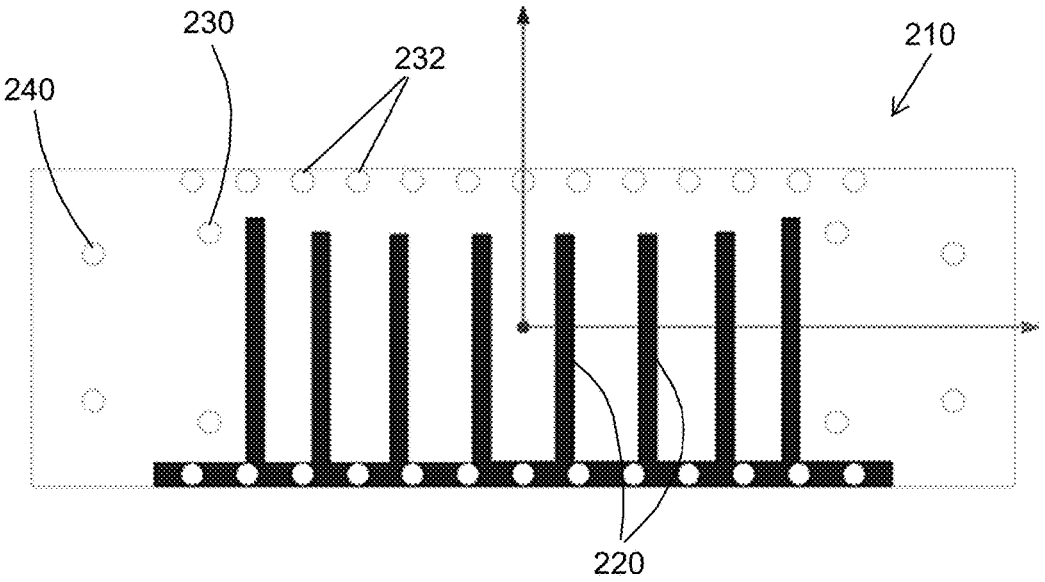
FIG. 6E shows one embodiment of a fifth layer of the broadband filter having combline topology as shown in FIG. 5A.

FIG. 6E shows one embodiment of a fifth 210, conductor, layer of the broadband filter having combline topology as shown in FIG. 5A. The overall length of the fifth layer is about 8.018 mm and the width of the fifth layer is about 2.6 mm. The fifth conductive layer 210 is complimentary to the conductive layer found in the third layer 206 to form the combline configuration where the poles 220 are parallel aligned within a layer, and between conductive layers, but are offset along the length of the pole 222 with respect to the corresponding pole in another layer, as shown in FIG. 5C. There, the overlay of the two conductive layers can be seen such that each of the parallel aligned poles in the third layer 206 are aligned with a corresponding poles of the fifth layer 210 (e.g., the first pole in the third layer is aligned with the first pole in the fifth layer, the second pole in the third layer is aligned with the second pole in the fifth layer, and so on), but each pole is slightly offset 222, lengthwise with respect to the pole below it. There, the poles have an actual length and an overlap length. The parallel aligned strips on FIG. 6C and on FIG. 6E are coupled to form the coupled stripline resonator. Each resonator is made up of two strips. A first strip is on FIG. 6C and the second strip is on FIG. 6E and they are shortened at their opposing ends. This coupling between the two strips significantly reduces the length of the resonator, and ultimately, the size of the filter.

Figure 6F:
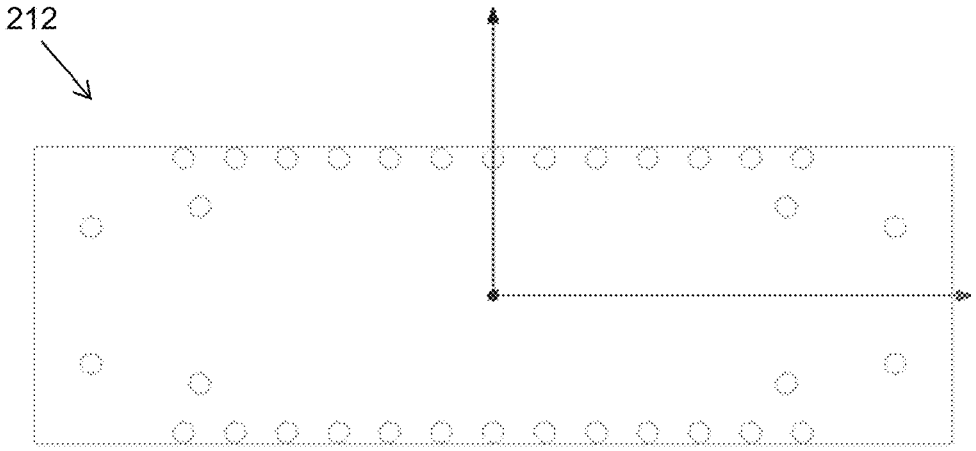
FIG. 6F shows one embodiment of a sixth layer of the broadband filter having combline topology as shown in FIG. 5A.

FIG. 6F shows one embodiment of a sixth 212, dialectic, layer of the broadband filter having combline topology as shown in FIG. 5A. In this example, the length of the sixth layer is about 8.018 mm and the width of the sixth layer is about 2.6 mm.

Figure 6G:
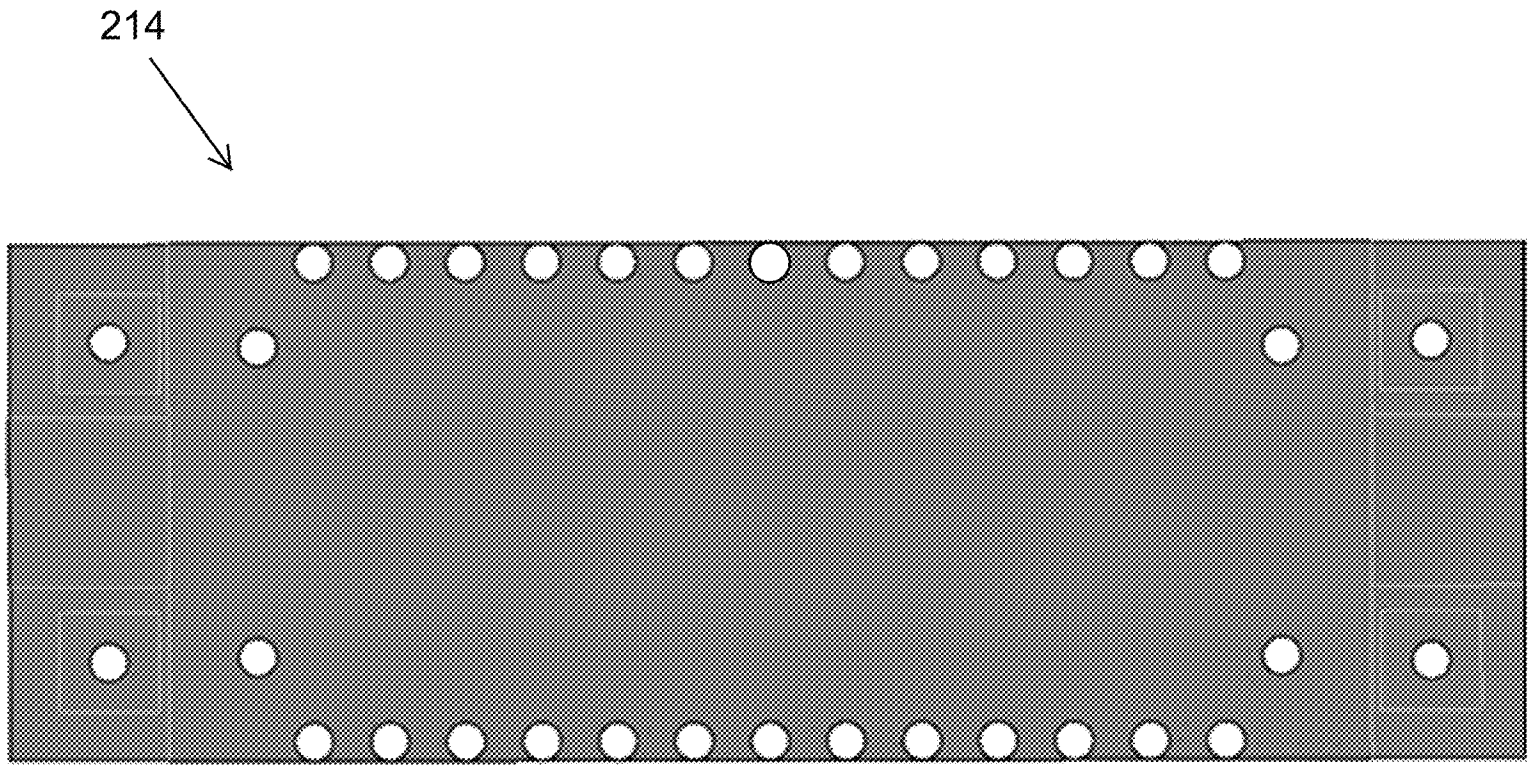
FIG. 6G shows one embodiment of a seventh layer of the broadband filter having combline topology as shown in FIG. 5A.

FIG. 6G shows one embodiment of a seventh 214, ground, layer of the broadband filter having combline topology as shown in FIG. 5A. In this example, the length of the seventh layer is about 8.018 mm and the width of the seventh layer is about 2.6 mm.

TABLE 2

| Broadband filters (3.0 GHz and 4.5 GHz bandwidths) | | | | |
|---|---|---|---|---|
| Center Frequency/ Filter Topology | Bandwidth | Insertion loss at center frequency | Filter size | Filter Performance |
| 8.2 GHz Interdigital Filter | 3 GHz | 0.69 dB | Height = 1.7 mm Width = 2.6 mm Length = 9.1 mm | FIG. 10A-FIG. 10D |
| 15.75 GHz Interdigital Filter | 4.5 GHz | 0.64 dB | Height = 1.7 mm Width = 2.4 mm Length = 10.1 mm | FIG. 11A-FIG. 11D |
| 8.2 GHz Combline Filter | 3 GHz | 0.79 dB | Height = 1.7 mm Width = 2.6 mm Length = 9.1 mm | FIG. 12A-FIG. 12D |
| 15.75 GHz Combline Filter | 4.5 GHz | 0.76 dB | Height = 1.7 mm Width = 2.4 mm Length = 10.1 mm | FIG. 13A-FIG. 13D |

Some exemplary broadband filters are shown in Table 2, above. There, the filters had 3.0 or 4.5 GHz bandwidths and a range of center frequencies. These broadband filters had either interdigital or combline topology and small overall size as compared to typical broadband filters. The filters ranged in length from about 8 mm to about 10 mm, ranged in height from about 1.5 mm to about 2 mm, and ranged in width from about 2 mm to about 3 mm. The frequency range is determined by the width and length of the two strips making up the resonator. The filter bandwidth (the width of the filter) is determined by the coupling between adjacent resonators. For broadband filters, the adjacent resonators are very close to each other in order to achieve wider coupling to implement a broadband filter design.

Additionally, as noted in Table 2, plots of the performance for various exemplary broadband filters will be discussed in more detail in FIG. 10A-FIG. 10D, FIG. 11A-FIG. 11D, FIG. 12A-FIG. 12D, and FIG. 13A-FIG. 13D, respectively, following the discussion of the performance for the various exemplary narrowband filters.

This new filter concept was introduced through HFSS simulation with 0.3 GHz to 4.5 GHz bandwidth filters operating in X and Ku band being implemented successfully to date. The fabrication process and sensitivity dictated the bandwidth limitations in many cases. For example, some limitations include the diameter and spacing of the vias and the minimum gap between two adjacent resonators.

It was found that the interdigital filters allowed cross-coupling between non-adjacent resonators thus introducing transmission zeroes at the rejections. These cross-couplings got stronger as the gaps between the resonators got smaller in the broadband filter implementations. The combline filter had much weaker cross-coupling between non-adjacent resonators than was seen in the interdigital filter due to weak coupling between non-adjacent resonators in the combline filter.

The passband loss for the interdigital filter was better than the combline filter especially at the upper band edge. The overall performance of the interdigital filter was found to be much better than combline filters for the applications and ranges tested. In some cases, the resonators re-entrance at higher frequency and higher order modes appear at higher frequency requiring a cleanup lowpass filter for high frequency rejection requirements. See, for example, the combline and interdigital filter plots.

Figure 7A:
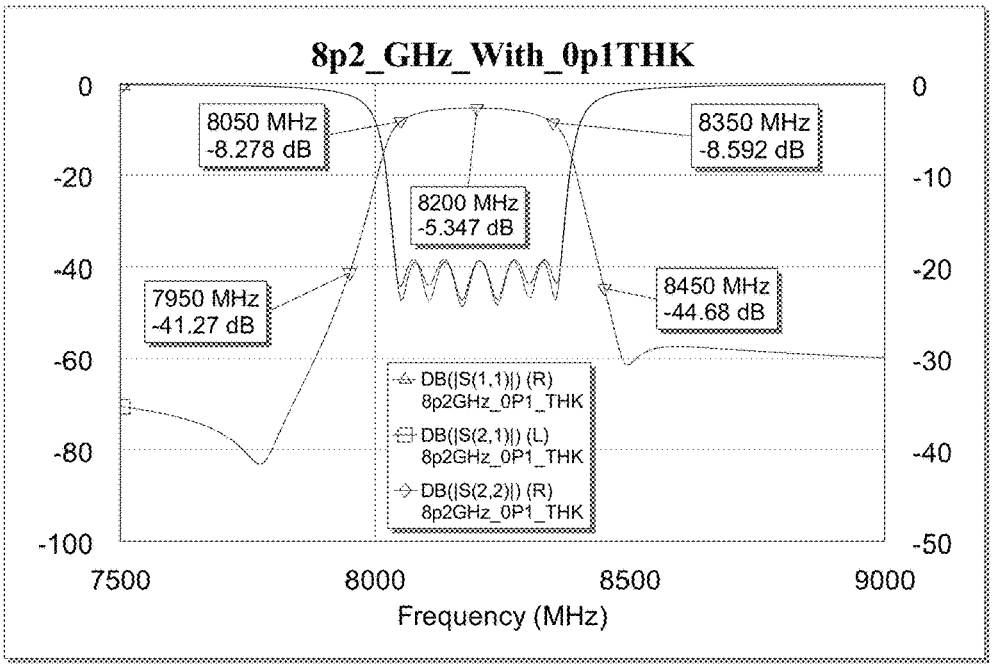
FIG. 7A-FIG. 7D are various plots of forward return losses (1,1), reverse return losses (2,2), and insertion losses (2,1) for a narrowband filter with interdigital topology and a center frequency of 8.2 GHz according to the principles of the present disclosure.
Figure 7B:
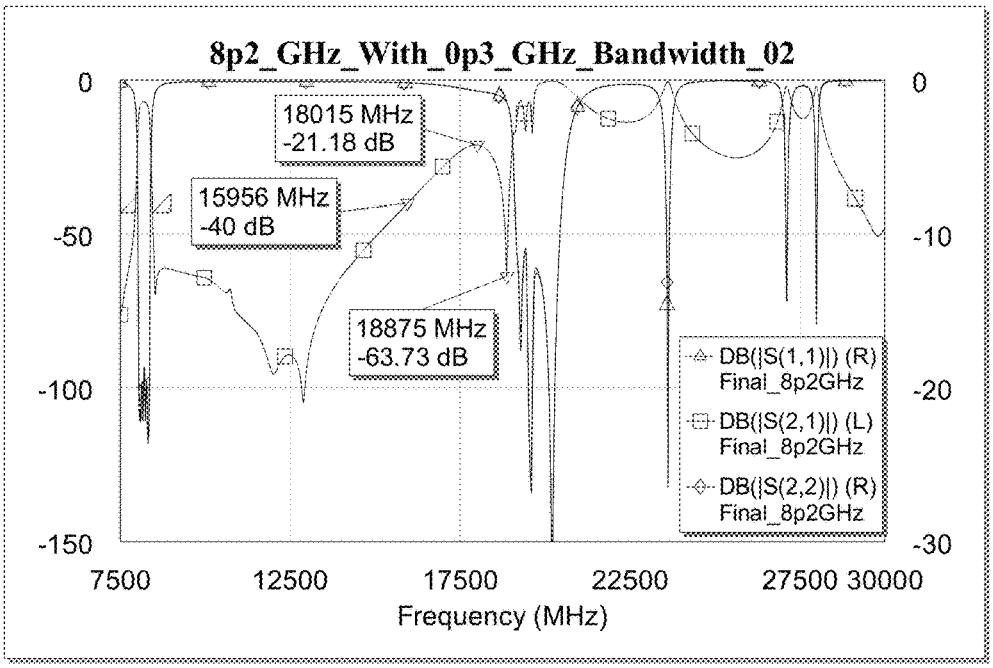
Figure 7C:
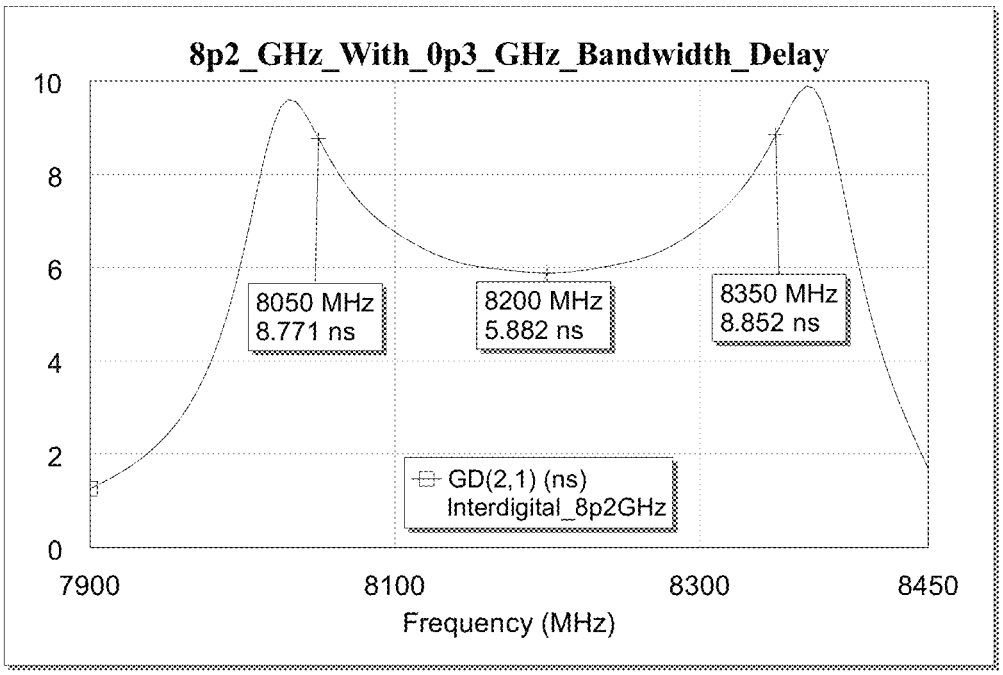
Figure 7D:
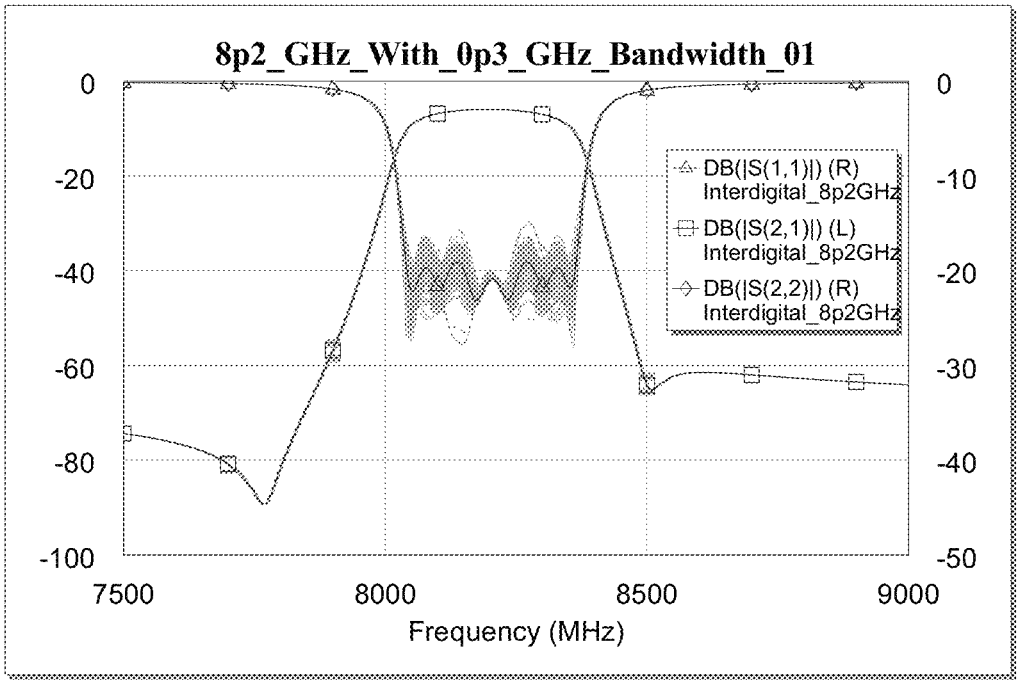

FIG. 7A-FIG. 7D show various plots of forward return losses (1,1), reverse return losses (2,2) and insertion losses (2,1) for a narrowband filter with interdigital topology and a center frequency of 8.2 GHz according to the principles of the present disclosure. More specifically, the narrowband filter has a 0.3 GHz bandwidth. FIG. 7A shows that the filter has an insertion loss of about 5.35 dB at the center frequency. A minimum of 33 dB rejection at 100 MHz away from the band edges. FIG. 7C shows a 3 ns delay flatness across the passband of 8050 MHz to 8350 MHz and FIG. 7D shows a low sensitivity over fabrication process parameters.

Figure 8A:
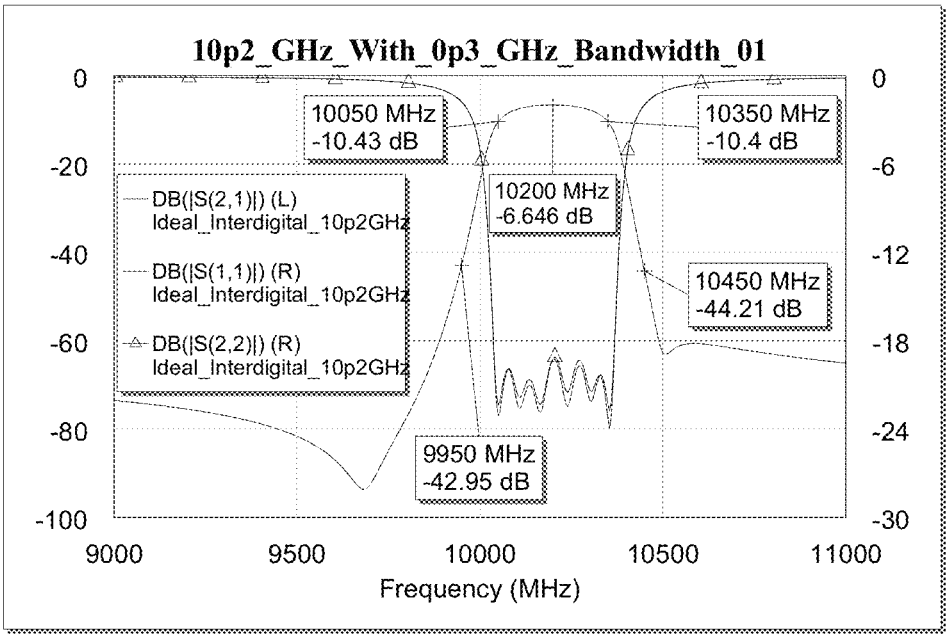
FIG. 8A-FIG. 8D are plots of forward return losses (1,1), reverse return losses (2,2), and insertion losses (2,1) for a narrowband filter with interdigital topology and a center frequency of 10.2 GHz according to the principles of the present disclosure.
Figure 8B:
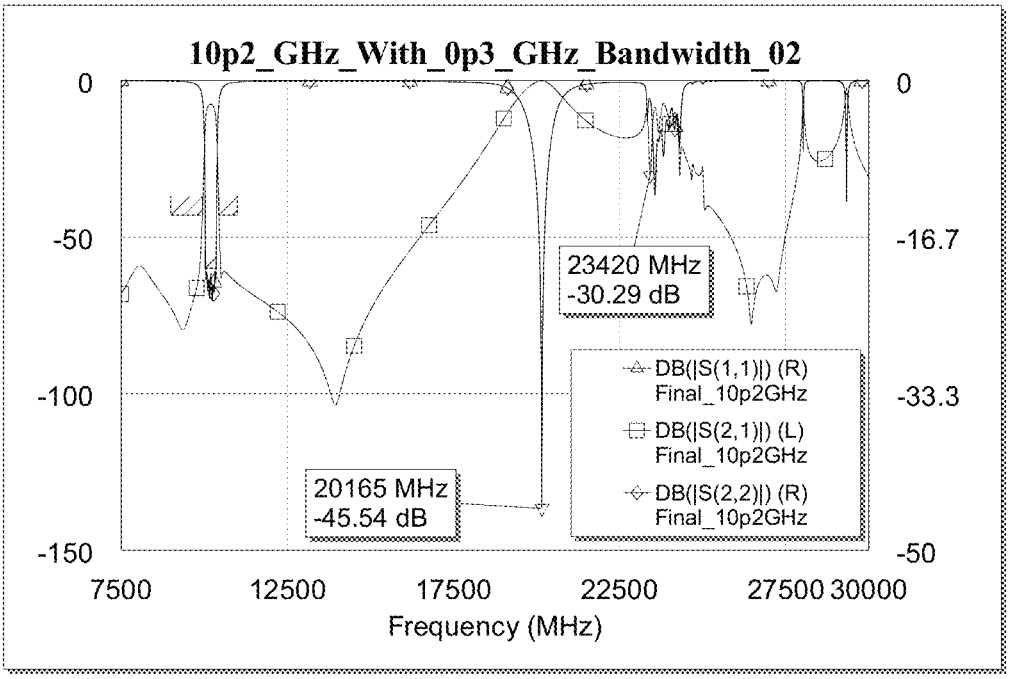
Figure 8C:
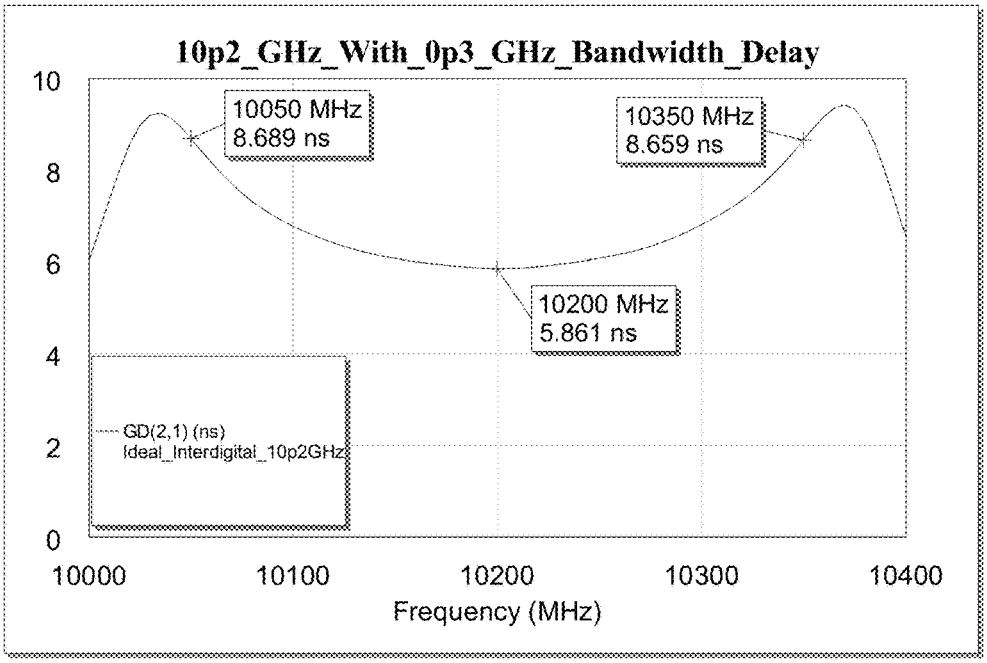
Figure 8D:
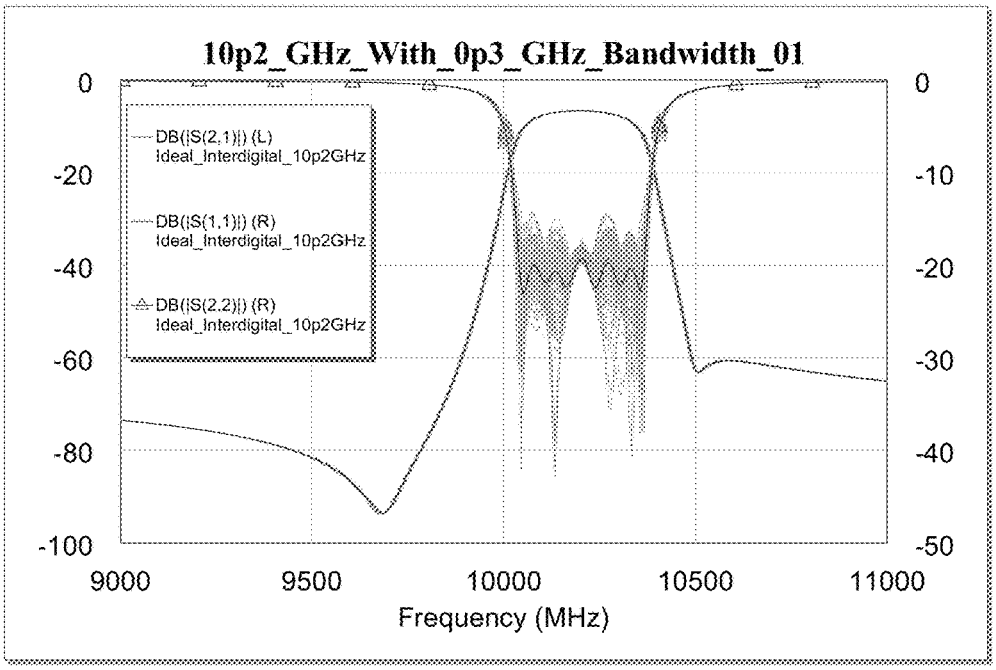

FIG. 8A-FIG. 8D show various plots of forward return losses (1,1), reverse return losses (2,2), and insertion losses (2,1) for a narrowband filter with interdigital topology and a center frequency of 10.2 GHz according to the principles of the present disclosure. More specifically, the narrowband filter has a 0.3 GHz bandwidth. FIG. 8A shows that the filter has an insertion loss of about 6.65 dB at the center frequency. A minimum of 32.5 dB rejection at 100 MHz away from the band edges. FIG. 8C shows a 2.83 ns delay flatness across the passband of 10,050 MHz to 10,350 MHz. FIG. 8D shows low sensitivity over fabrication process parameters.

Figure 9A:
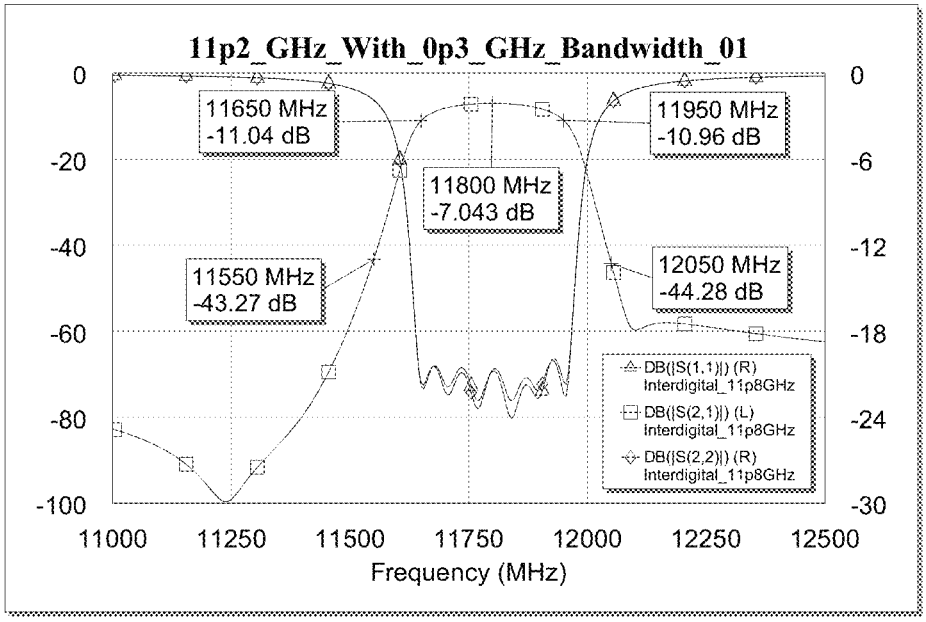
FIG. 9A-FIG. 9D are plots of forward return losses (1,1), reverse return losses (2,2), and insertion losses (2,1) for a narrowband filter with interdigital topology and a center frequency of 11.8 GHz according to the principles of the present disclosure.
Figure 9B:
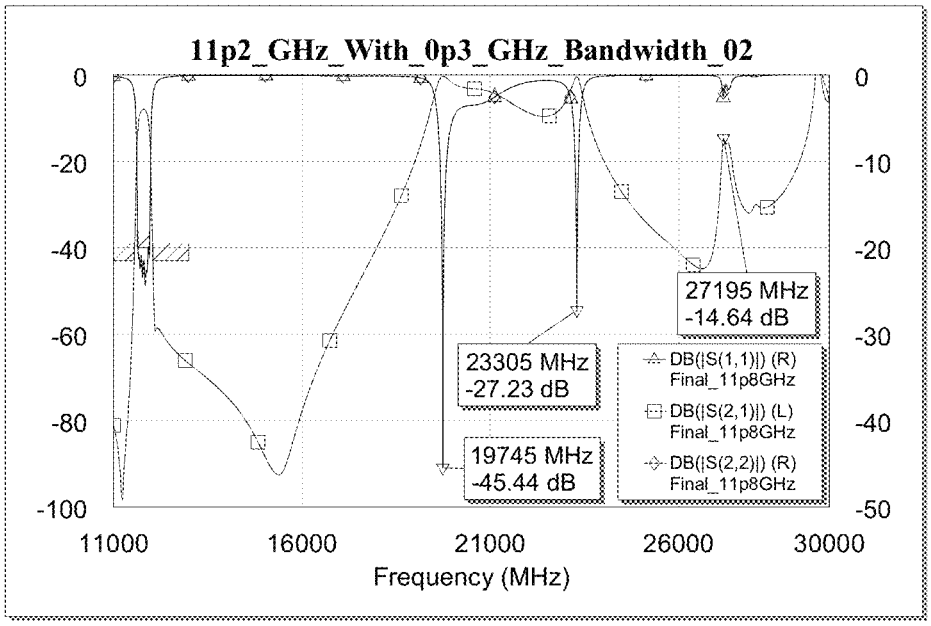
Figure 9C:
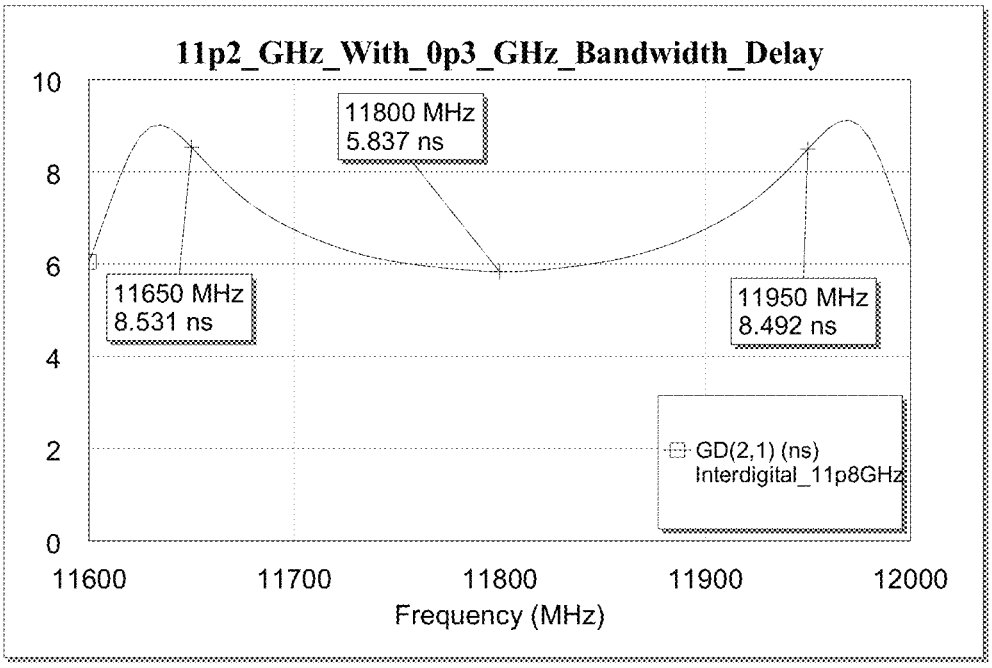
Figure 9D:
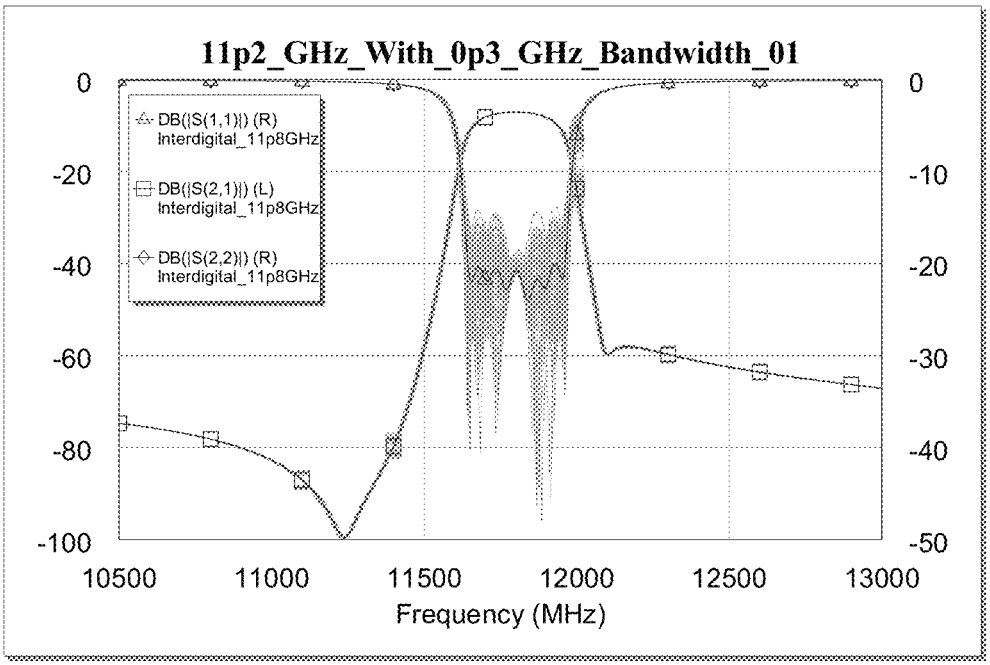

FIG. 9A-FIG. 9D show various plots of forward return losses (1,1), reverse return losses (2,2), and insertion losses (2,1) for a narrowband filter with interdigital topology and a center frequency of 11.8 GHz according to the principles of the present disclosure. More specifically, the narrowband filter has a 0.3 GHz bandwidth. FIG. 9A shows that the filter has an insertion loss of about 7.04 dB at the center frequency. A minimum of 32.2 dB rejection at 100 MHz away from the band edges. FIG. 9C shows a 2.7 ns delay flatness across the passband of 11,650 MHz to 11,950 MHz. FIG. 9D shows low sensitivity over fabrication process parameters.

Figure 10A:
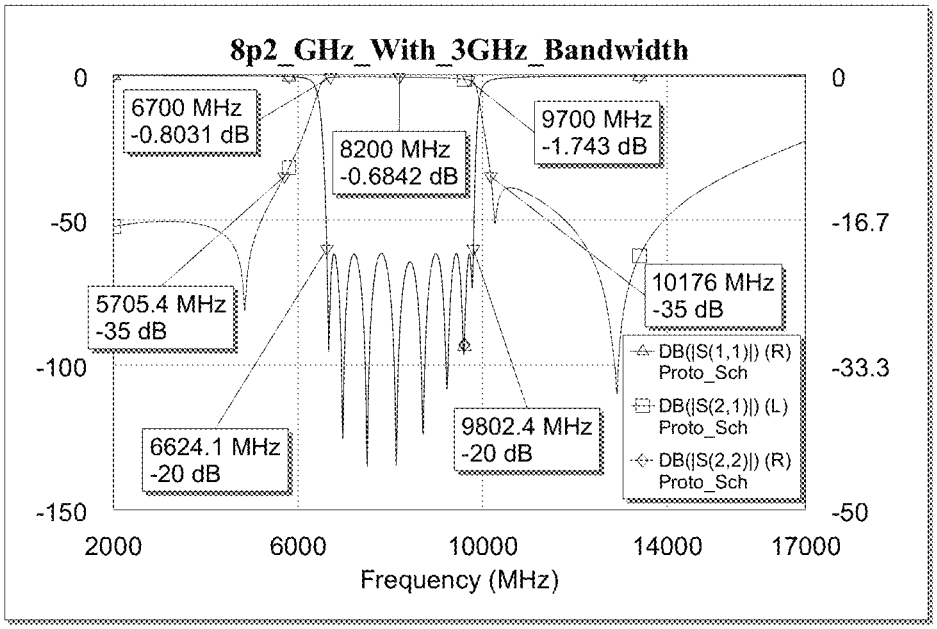
FIG. 10A-FIG. 10D are plots of forward return losses (1,1), reverse return losses (2,2), and insertion losses (2,1) for a broadband filter with interdigital topology and a center frequency of 8.2 GHz according to the principles of the present disclosure.
Figure 10B:
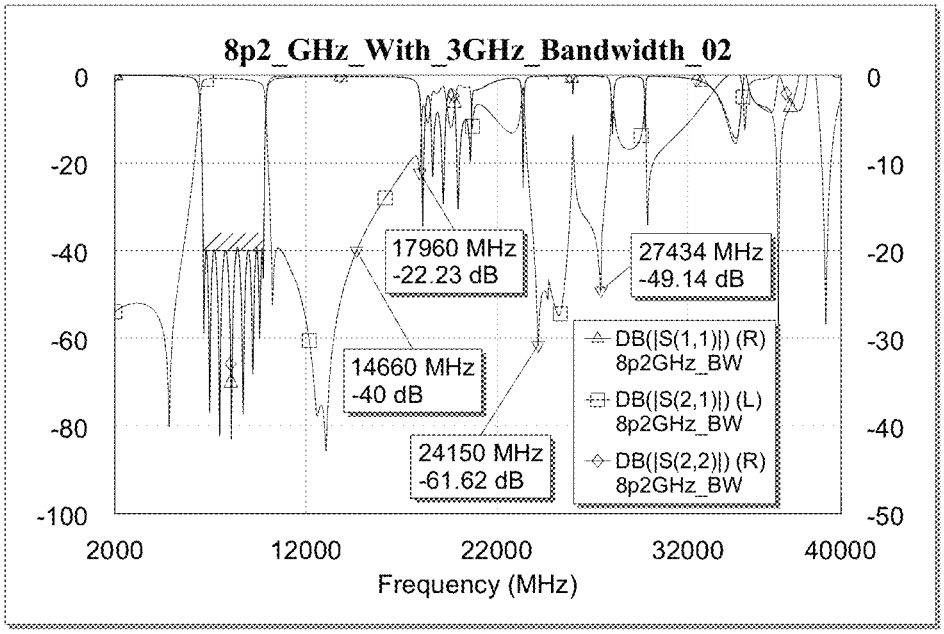
Figure 10C:
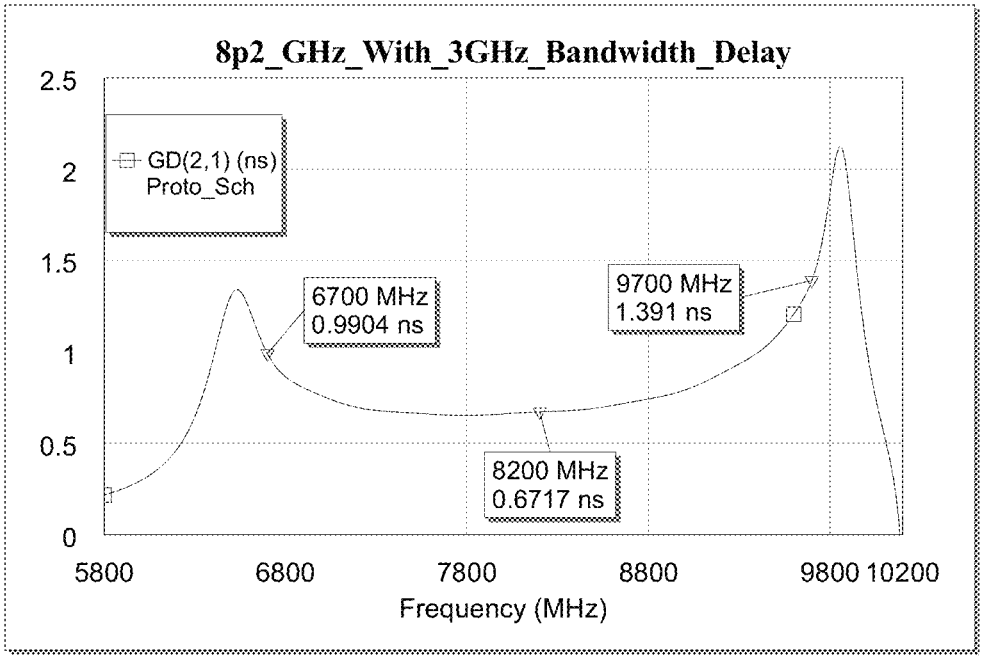
Figure 10D:
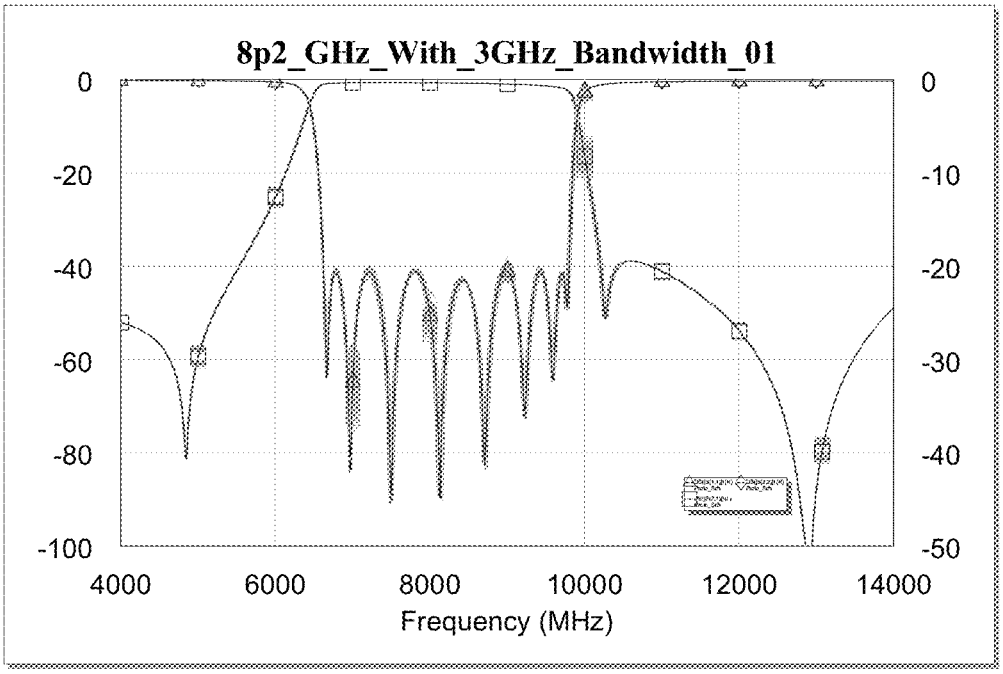

FIG. 10A-FIG. 10D show various plots of forward return losses (1,1), reverse return losses (2,2), and insertion losses (2,1) for a broadband filter with interdigital topology and a center frequency of 8.2 GHz according to the principles of the present disclosure. More specifically, the broadband filter has a 3 GHz bandwidth. FIG. 10A shows that the filter has an insertion loss of about 0.68 dB at the center frequency. Additionally, FIG. 10B shows a transmission zero below band and two transmission zeroes above band. These features improve the filter rejections. A minimum of 34 dB rejection at 995 MHz away from the band edges is shown. FIG. 10C shows a 0.72 ns delay flatness across the passband of 6,700 MHz to 9,700 MHz. FIG. 10D shows low sensitivity over fabrication process parameters. FIG. 10B shows the high order ceramic modes begin at 17,960 MHz.

Figure 11A:
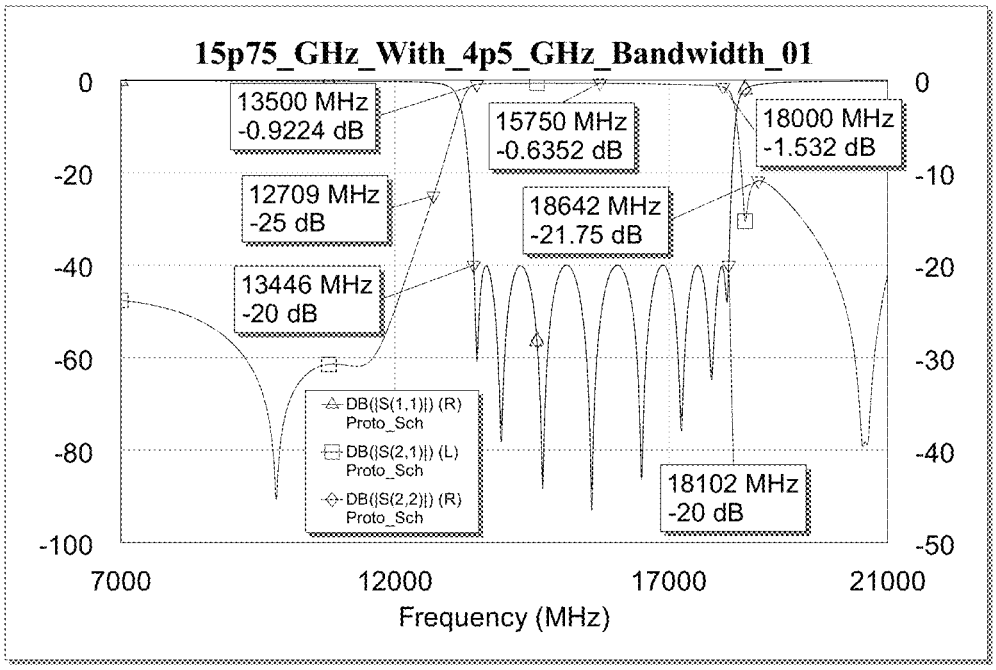
FIG. 11A-FIG. 11D are plots of forward return losses (1,1), reverse return losses (2,2), and insertion losses (2,1) for a broadband filter with interdigital topology and a center frequency of 15.75 GHz according to the principles of the present disclosure.
Figure 11B:
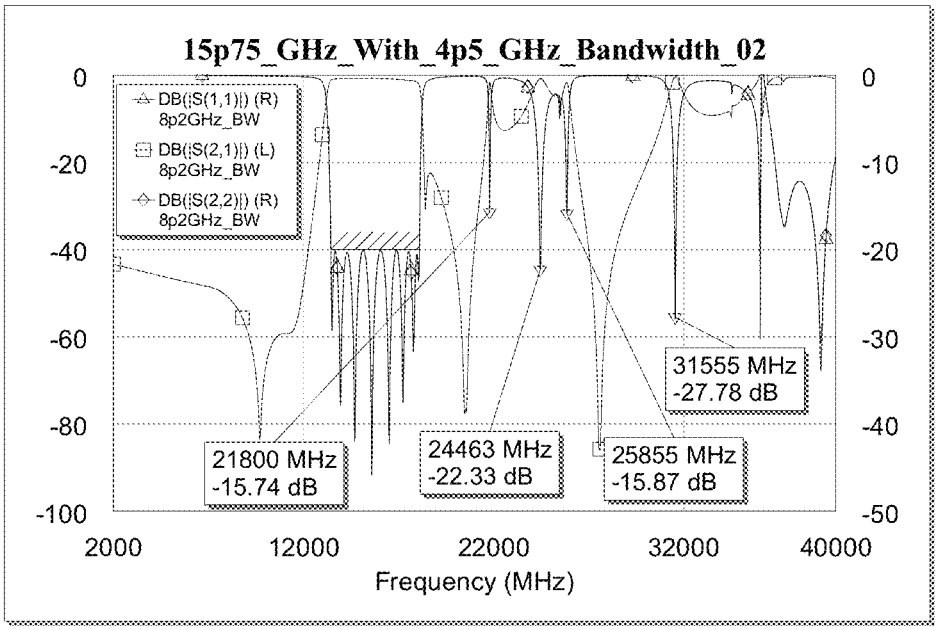
Figure 11C:
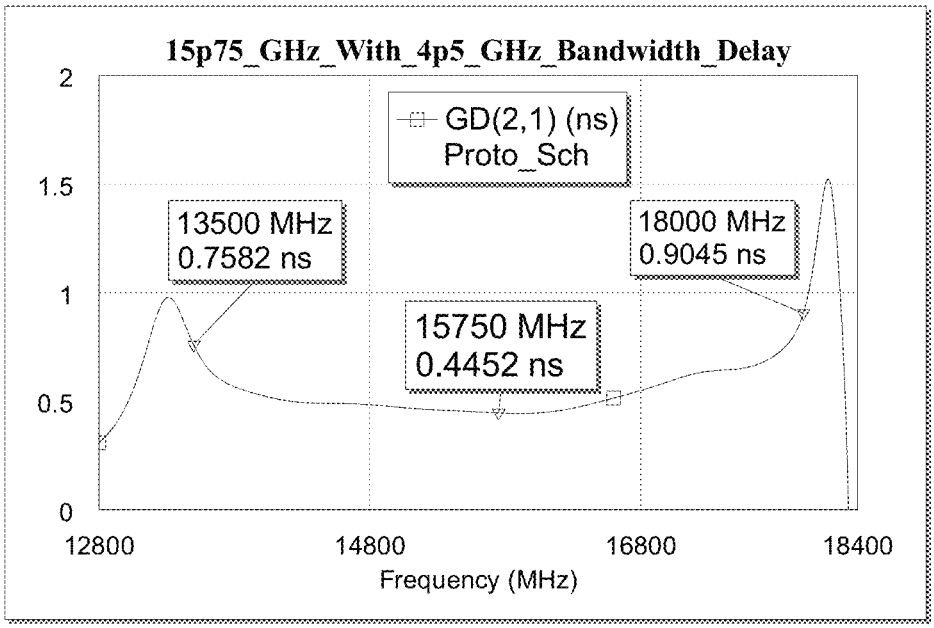
Figure 11D:
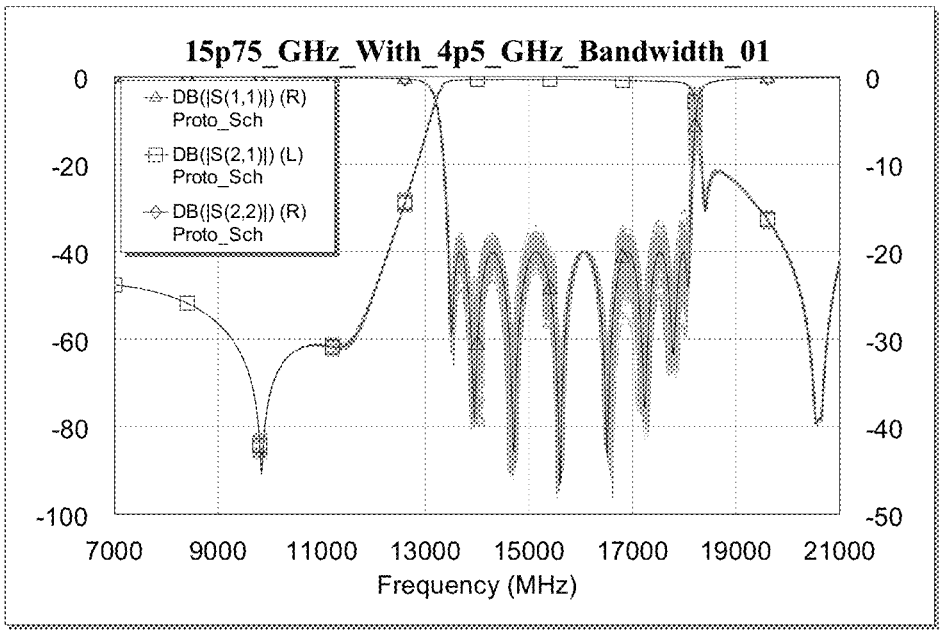

FIG. 11A-FIG. 11D show various plots of forward return losses (1,1), reverse return losses (2,2), and insertion losses (2,1) for a broadband filter with interdigital topology and a center frequency of 15.75 GHz according to the principles of the present disclosure. More specifically, the broadband filter has a 4.5 GHz bandwidth. FIG. 11A shows that the filter has an insertion loss of about 0.64 dB at the center frequency. A minimum of 24 dB rejection at 800 MHz away from the band edges. FIG. 11C shows a 0.15 ns delay flatness across the passband of 13,500 MHz to 18,000 MHz. FIG. 11D shows low sensitivity over fabrication process parameters. FIG. 11B shows the high order ceramic modes begin at 21,800 MHz.

Figure 12A:
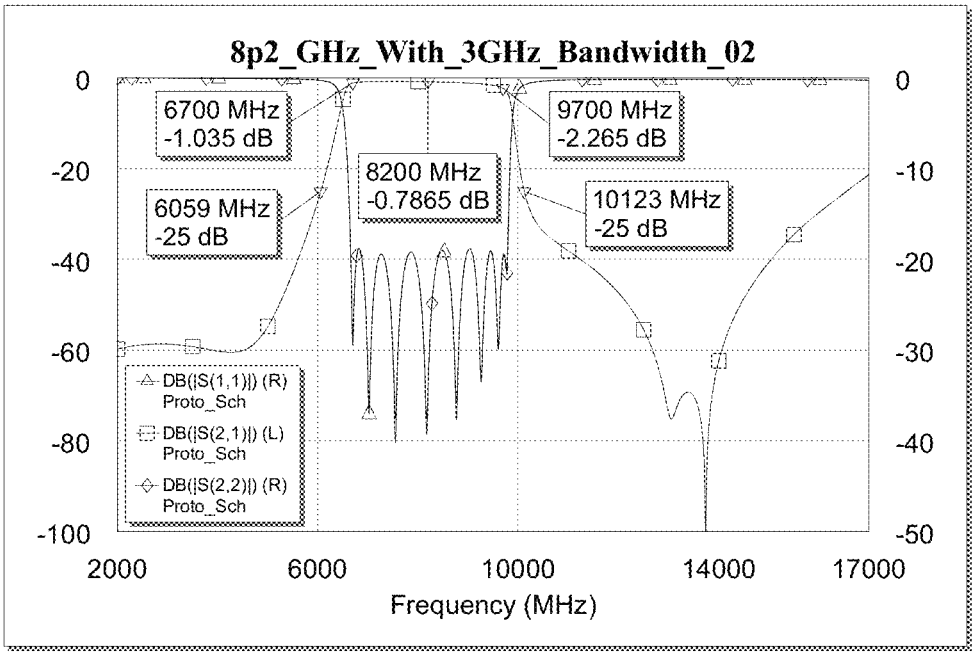
FIG. 12A-FIG. 12D are plots of forward return losses (1,1), reverse return losses (2,2), and insertion losses (2,1) for a broadband filter with combline topology and a center frequency of 8.2 GHz according to the principles of the present disclosure.
Figure 12B:
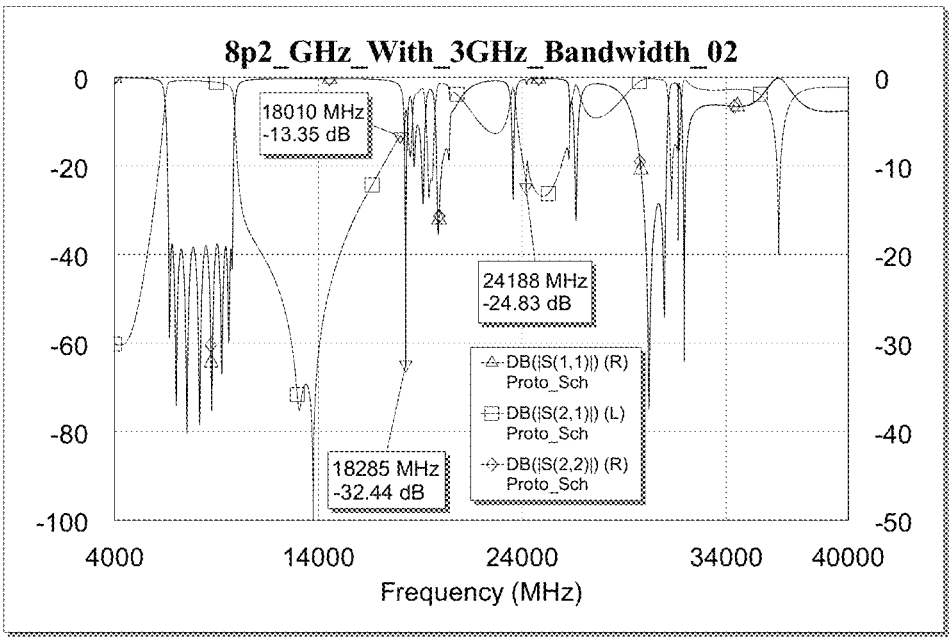
Figure 12C:
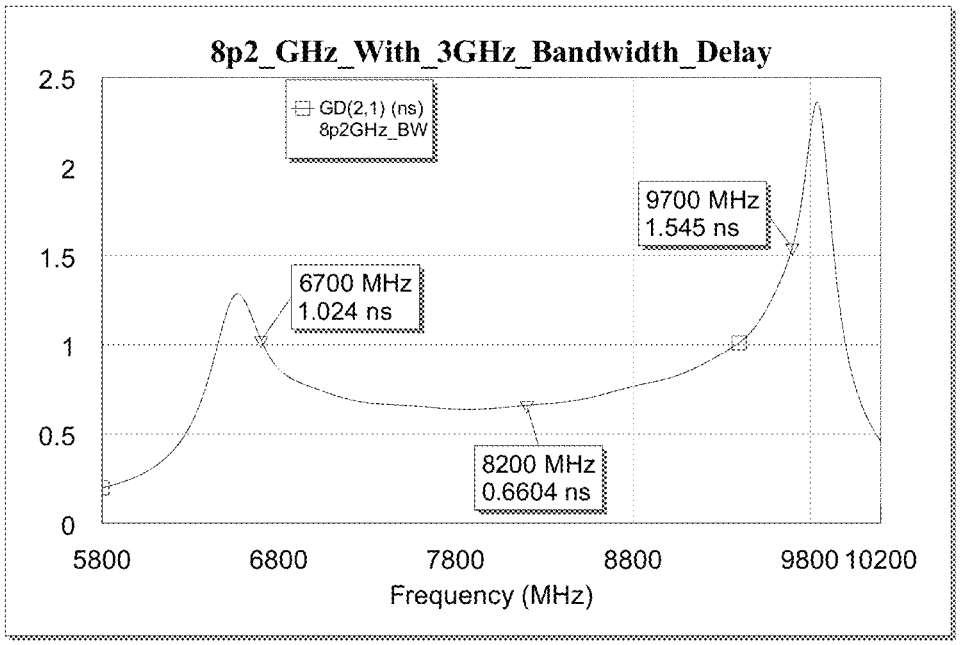
Figure 12D:
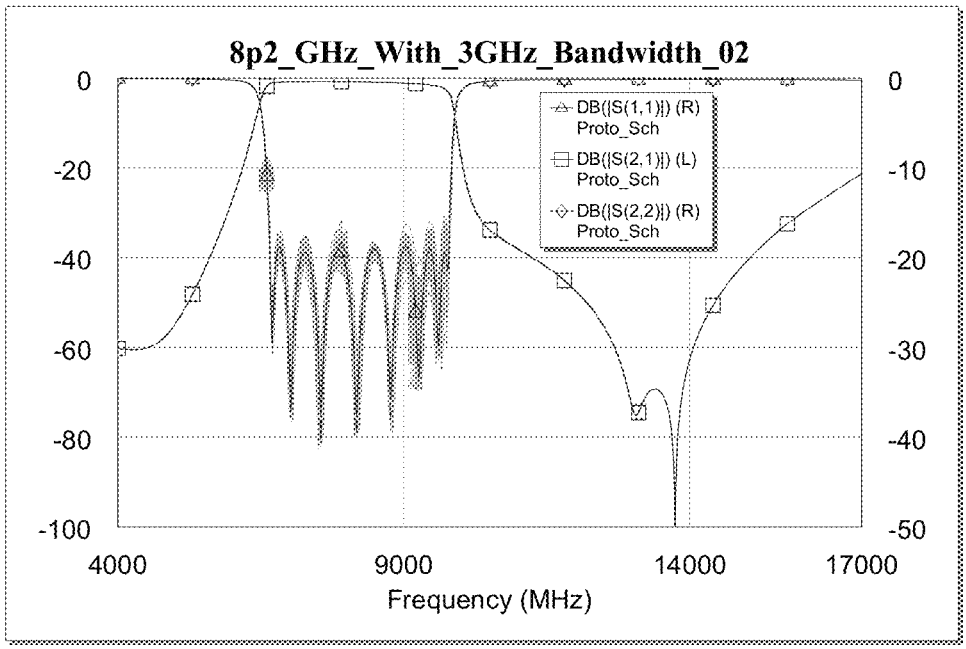

FIG. 12A-FIG. 12D show various plots of forward return losses (1,1), reverse return losses (2,2), and insertion losses (2,1) for a broadband filter with combline topology and a center frequency of 8.2 GHz according to the principles of the present disclosure. More specifically, the broadband filter has a 3 GHz bandwidth. FIG. 12A shows that the filter has an insertion loss of about 0.79 dB at the center frequency. A minimum of 24 dB rejection at 641 MHz away from the lower band edge and 20 dB rejection at 423 MHz away from the higher band edge. FIG. 12C shows a 0.88 ns delay flatness across the passband of 6,700 MHz to 9,700 MHz. FIG. 12D shows low sensitivity over fabrication process parameters. FIG. 12B shows the high order ceramic modes begin at 18,285 MHz.

Figure 13A:
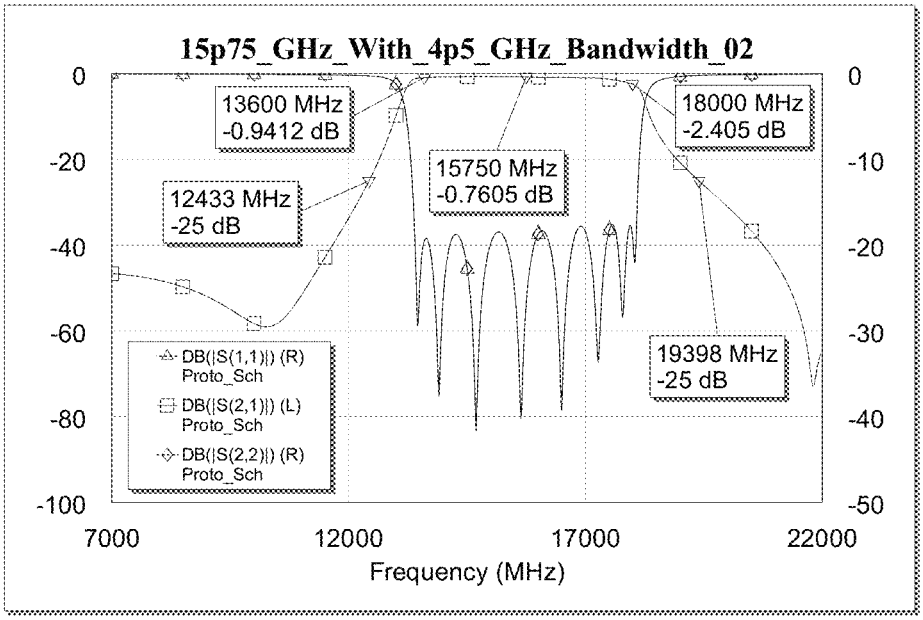
FIG. 13A-FIG. 13D are plots of forward return losses (1,1), reverse return losses (2,2), and insertion losses (2,1) for a broadband filter with combline topology and a center frequency of 15.75 GHz according to the principles of the present disclosure.
Figure 13B:
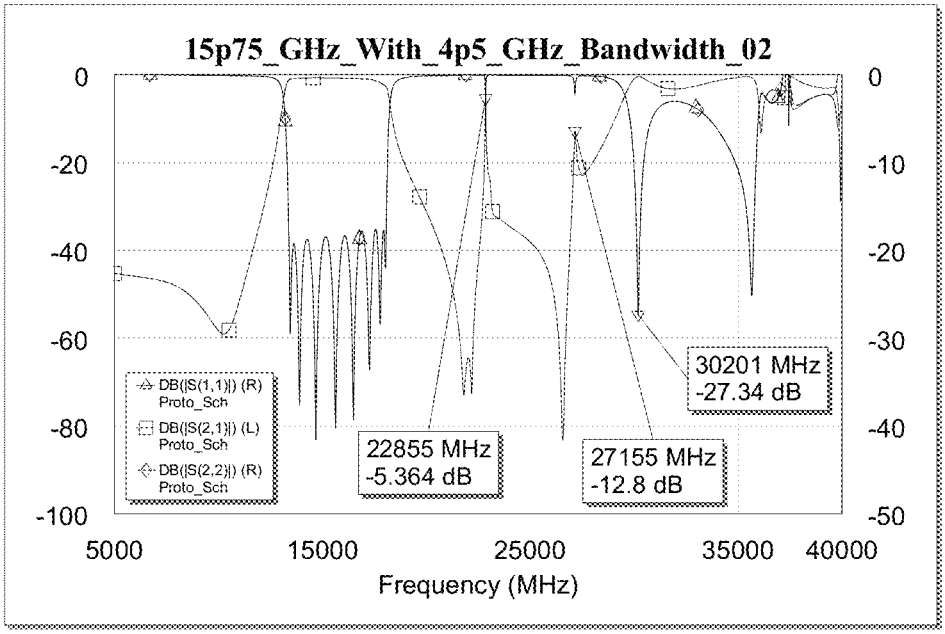
Figure 13C:
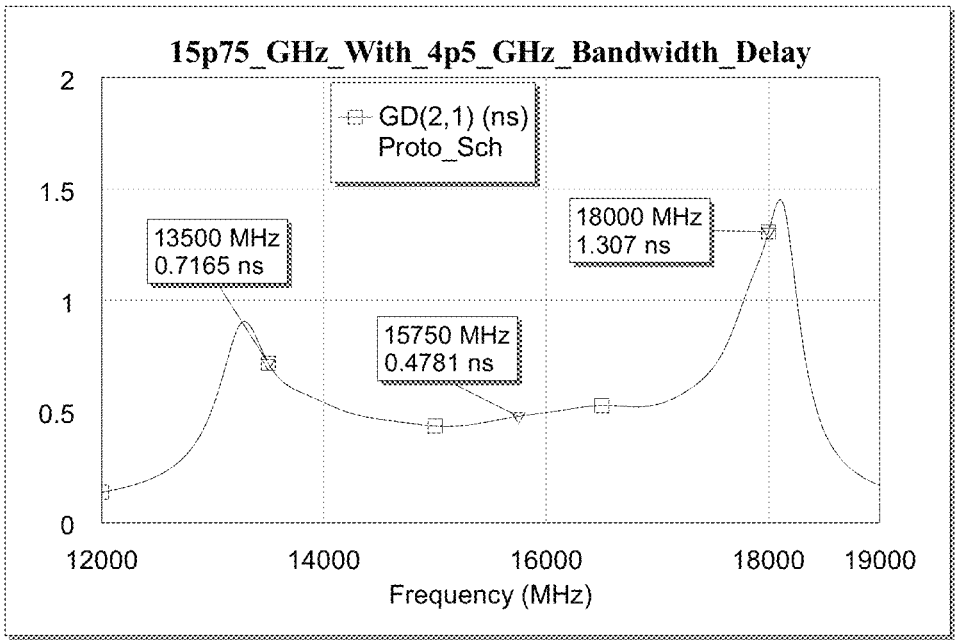
Figure 13D:
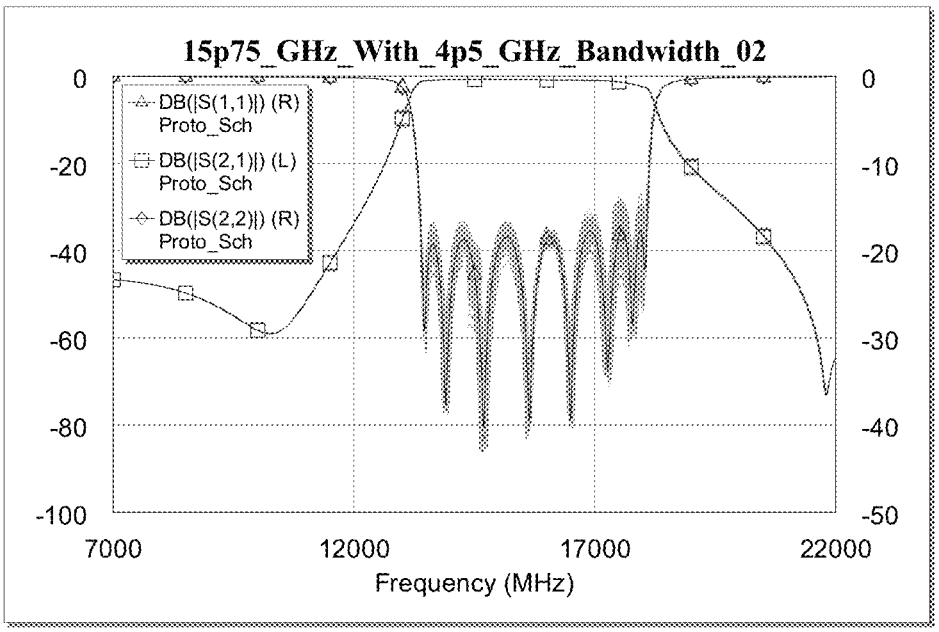

FIG. 13A-FIG. 13D show various plots of forward return losses (1,1), reverse return losses (2,2), and insertion losses (2,1) for a broadband filter with combline topology and a center frequency of 15.75 GHz according to the principles of the present disclosure. More specifically, the broadband filter has a 4.5 GHz bandwidth. FIG. 13A shows that the filter has an insertion loss of about 0.76 dB at the center frequency. A minimum of 24 dB rejection at 1,167 MHz away from the lower band edge and 22.6 dB rejection at 1,398 MHz away from the higher band edge. FIG. 13C shows a 0.83 ns delay flatness across the passband of 13,600 MHz to 18,000 MHz. FIG. 13D shows a low sensitivity over fabrication process parameters. FIG. 13B shows the high order ceramic modes begin at 22,855 MHz.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A low temperature co-fired ceramic stripline resonator filter comprising:

a first layer configured as a ground layer comprising a metal;

a second layer comprising a dielectric material;

a third layer configured as a conductor layer comprising the metal and the dielectric material, the metal comprising a plurality of resonators comprising a first half of a stripline resonator pair arranged with an interdigital topology;

a fourth layer comprising the dielectric material;

a fifth layer configured as a conductor layer comprising the metal and the dielectric material, the metal comprising a plurality of resonators comprising a second half of the stripline resonator pair arranged with an interdigital topology;

a sixth layer comprising the dielectric material;

a seventh layer configured as a ground layer comprising the metal;

wherein the first, second, third, fourth, fifth, sixth and seventh layers are assembled to form the stripline filter having a width, a length, a thickness, a first end and a second end, and a first side and a second side;

a narrowband filter transformer loading structure launches an input and an output to a first and a second resonator of the stripline resonator pair, respectively;

a plurality of perimeter through plated vias being spaced apart along the length of the first side and along the length of the second side of the stripline filter and extending through the stripline filter from the first layer to the seventh layer creating a series of electric walls to contain electromagnetic fields inside the stripline filter; and a plurality of through plated vias located between adjacent resonators of the stripline resonator pair and extending through the stripline filter from the first layer to the seventh layer to create a series of further electric walls thereby reducing the coupling between the adjacent resonators thereby forming a narrowband filter with a bandwidth of about 0.3 GHz to less than 1 GHz.

2. The low temperature co-fired ceramic stripline resonator filter of claim 1, wherein the dielectric material is any LTCC low loss dielectric material.

3. The low temperature co-fired ceramic stripline resonator filter of claim 1, wherein the metal is selected from gold or silver.

4. The low temperature co-fired ceramic stripline resonator filter of claim 1, wherein a plurality of resonator poles is between four and fourteen.

5. The low temperature co-fired ceramic stripline resonator filter of claim 1, wherein the filter has a frequency of operation ranging from 0.1 GHz to about 100 GHz.

6. A low temperature co-fired ceramic stripline resonator filter comprising:

a first layer configured as a ground layer comprising a metal;

a second layer comprising a dielectric material;

a third layer configured as a conductor layer comprising the metal and the dielectric material, the metal comprising a plurality of resonators comprising a first half of a stripline resonator pair arranged with a combline topology;

a fourth layer comprising the dielectric material;

a fifth layer configured as a conductor layer comprising the metal and the dielectric material, the metal comprising a plurality of resonators comprising a second half of the stripline resonator pair arranged with a combline topology;

a sixth layer comprising the dielectric material;

a seventh layer configured as a ground layer comprising the metal;

a narrowband filter transformer loading structure launches an input and an output to a first and a second resonator of the stripline resonator pair, respectively;

wherein the first, second, third, fourth, fifth, sixth and seventh layers are assembled to form the stripline filter having a width, a length, a thickness, a first end and a second end, and a first side and a second side;

a plurality of through plated vias located between adjacent resonators of the stripline resonator pair and extending through the stripline filter from the first layer to the seventh layer to create a series of electric walls thereby reducing the coupling between the adjacent resonators; and a plurality of perimeter through plated vias spaced apart along the length of the first side and along the length of the second side of the stripline filter and extending through the stripline filter from the first layer to the seventh layer creating a series of further electric wails to contain electromagnetic fields inside the stripline filter thereby forming a narrowband filter with a bandwidth of about 0.3 GHz to less than 1 GHz.

7. The low temperature co-fired ceramic stripline resonator filter of claim 6, wherein the dielectric material is any LTCC low loss dielectric material.

8. The low temperature co-fired ceramic stripline resonator filter of claim 6, wherein the metal is selected from gold or silver.

9. The low temperature co-fired ceramic stripline resonator filter of claim 6, wherein the filter has a center frequency of operation ranging from 0.1 GHz to about 100 GHz.

10. The low temperature co-fired ceramic stripline resonator filter of claim 6, wherein a plurality of resonator poles is between four and fourteen.

* * * * *